US010499745B2

(12) United States Patent
Adams et al.

(10) Patent No.: US 10,499,745 B2
(45) Date of Patent: Dec. 10, 2019

(54) TRANSFORMABLE SOFA

(71) Applicant: La-Z-Boy Incorporated, Monroe, MI (US)

(72) Inventors: Chad E. Adams, Perrysburg, OH (US); Larry P. Lapointe, Temperance, MI (US); Jason Bryson, Athens, TN (US); Ericka K. Norling, Dayton, TN (US); Jason D. Rains, Evensville, TN (US); Mark D. McClung, Grandview, TN (US); Tahir Ahmad, Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 336 days.

(21) Appl. No.: 15/369,950

(22) Filed: Dec. 6, 2016

(65) Prior Publication Data

US 2018/0153309 A1 Jun. 7, 2018

(51) Int. Cl.
*A47C 17/86* (2006.01)
*A47C 17/04* (2006.01)

(52) U.S. Cl.
CPC ..... *A47C 17/86* (2013.01); *A47C 17/04* (2013.01)

(58) Field of Classification Search
CPC ..... A47C 3/0257; A47C 7/024; A47C 7/14; A47C 13/00; A47C 13/005; A47C 15/004;

(Continued)

(56) References Cited

U.S. PATENT DOCUMENTS 1,063,809 A * 6/1913 Lawson ..... A47C 7/024 297/233
3,505,694 A * 4/1970 Pesta ..... A47C 17/04 5/17

(Continued)

FOREIGN PATENT DOCUMENTS

DE 3625225 A1 * 2/1988 ..... A47C 1/023
DE 3825406 A1 * 2/1990 ..... A47C 17/04

(Continued)

OTHER PUBLICATIONS

International Search Report for Application No. PCT/US2016/068322, dated Apr. 17, 2017.

(Continued)

*Primary Examiner* — Ryan D Kwiecinski
(74) *Attorney, Agent, or Firm* — Harness, Dickey & Pierce, P.L.C.

(57) ABSTRACT

A furniture member may include first and second seat assemblies and an auxiliary assembly. The first seat assembly includes a first seat bottom and a first seatback. The second seat assembly includes a second seat bottom and a second seatback. The second seat assembly may be movable relative to the first seat assembly between a retracted position in which the first seat bottom and the first seatback portion are adjacent to the second seat bottom and the second seatback, and an extended position in which the first seat bottom and the first seatback are spaced apart from the second seat bottom and the second seatback. The auxiliary assembly is movable between a stowed position in which the auxiliary assembly is disposed below the first and second seat assemblies and a deployed position in which at least a portion of the auxiliary assembly is vertically higher than in the stowed position.

50 Claims, 19 Drawing Sheets

(58) Field of Classification Search
CPC ..... A47C 17/00; A47C 17/04; A47C 17/1753; A47C 17/1756; A47C 17/20; A47C 17/207; A47C 17/22; A47C 17/86
See application file for complete search history.

(56) References Cited

U.S. PATENT DOCUMENTS

| | | | | |
|---|---|---|---|---|
| 3,743,351 | A * | 7/1973 | Harris | A47C 13/00 297/107 |
| 4,570,996 | A | 2/1986 | Rogers, Jr. | |
| 4,765,678 | A * | 8/1988 | Huang | A47C 13/005 297/236 |
| 4,861,101 | A | 8/1989 | Hartline | |
| 5,123,705 | A | 6/1992 | Johnson | |
| 5,794,283 | A | 8/1998 | Vila et al. | |
| 5,988,749 | A * | 11/1999 | Williams | A47C 17/134 297/337 |
| 6,588,837 | B1 | 7/2003 | Schultz et al. | |
| 9,211,012 | B1 * | 12/2015 | Wilson, II | A47C 7/66 |
| 10,010,185 | B2 | 7/2018 | Adams et al. | |
| 2002/0014795 | A1 * | 2/2002 | Williams | A47C 1/023 297/337 |
| 2005/0052067 | A1 | 3/2005 | Grimm et al. | |
| 2009/0183308 | A1 * | 7/2009 | Roma | A47C 17/1753 5/37.1 |
| 2014/0265497 | A1 | 9/2014 | Hough et al. | |
| 2015/0040314 | A1 | 2/2015 | Cabrera et al. | |
| 2015/0245716 | A1 * | 9/2015 | Hwang | A47C 11/00 297/284.3 |
| 2016/0150887 | A1 * | 6/2016 | Wallis | B60N 2/00 297/283.2 |
| 2018/0055237 | A1 * | 3/2018 | Odutayo | A47C 7/002 |

FOREIGN PATENT DOCUMENTS

| | | | | |
|---|---|---|---|---|
| DE | 19700815 | A1 * | 7/1998 | A47C 17/36 |
| EP | 0496249 | A1 | 7/1992 | |
| FR | 2519533 | A1 * | 7/1983 | A47C 7/68 |

OTHER PUBLICATIONS

Written Opinion of the International Searching Authority for Application No. PCT/US2016/068322, dated Apr. 17, 2017.

* cited by examiner

TRANSFORMABLE SOFA

FIELD

The present disclosure relates to a transformable furniture member, and more particularly, to a transformable sofa.

BACKGROUND

This section provides background information related to the present disclosure and is not necessarily prior art.

A furniture member (e.g., a chair, sofa, loveseat, etc.) is often selected for placement in a given room within a home or place of business based on an amount available space in the room and an amount of seating space that the furniture member provides (i.e., the number of people that can sit on the furniture member and/or whether a person can comfortably lie down on the furniture member). Often, the size of the room and planned activities in the room restrict an amount of space that can be allocated in the room for the furniture member. The present disclosure provides a furniture member that is movable between one arrangement in which the furniture member has a smaller footprint to reduce the amount of space that the furniture member occupies, and another arrangement in which the furniture member provides increased seating space. The user can easily move the furniture member between the arrangements as desired.

SUMMARY

This section provides a general summary of the disclosure, and is not a comprehensive disclosure of its full scope or all of its features.

The present disclosure provides a furniture member that may include a first seat assembly, a second seat assembly, and an auxiliary assembly. The first seat assembly may include a first seat bottom and a first seatback. The second seat assembly may include a second seat bottom and a second seatback. The second seat assembly may be connected to the first seat assembly and may be movable relative to the first seat assembly between a retracted position in which the first seat bottom and the first seatback are adjacent to the second seat bottom and the second seatback, respectively, and an extended position in which the first seat bottom and the first seatback are spaced apart from the second seat bottom and the second seatback, respectively. The auxiliary assembly may be connected to the first and second seat assemblies. The auxiliary assembly may be movable between a stowed position in which the auxiliary assembly is disposed vertically between a ground surface upon which the furniture member is disposed and the first and second seat assemblies and a deployed position in which at least a portion of the auxiliary assembly is disposed vertically higher than in the stowed position.

In some configurations, the auxiliary assembly includes a seat assembly. Additionally or alternatively, the auxiliary assembly could include an armrest, a console, and/or a table, for example.

In some configurations, the auxiliary assembly is disposed laterally between the first and second seat bottoms when the auxiliary assembly is in the deployed position.

In some configurations, the auxiliary assembly is movable to the deployed position only when the second seat assembly is in the extended position.

In some configurations, the second seat assembly is movable to the retracted position only when the auxiliary assembly is the stowed position.

In some configurations, the auxiliary assembly includes a third seat bottom, a third seatback, and an auxiliary frame supporting the third seat bottom and the third seatback.

In some configurations, the furniture member includes a first actuator attached to the first and second seat assemblies and selectively moving the second seat assembly relative to the first seat assembly between the retracted and extended positions.

In some configurations, the auxiliary assembly includes an auxiliary frame including a first auxiliary frame portion and a second auxiliary frame portion that is movable relative to the first auxiliary frame portion.

In some configurations, the first auxiliary frame portion is mounted to the first and second seat assemblies and movable relative to the first and second seat assemblies in a lateral direction as the second seat assembly moves between the retracted and extended positions.

In some configurations, the second auxiliary frame portion is mounted to the first auxiliary frame portion for movement relative to the first auxiliary frame portion in a vertical direction and in a fore-aft direction. The vertical direction is perpendicular to the lateral direction, and the fore-aft direction is perpendicular to the lateral direction and the vertical direction.

In some configurations, the auxiliary assembly includes a second actuator mounted to the first and second auxiliary frame portions and selectively moving the second auxiliary frame portion in the fore-aft direction relative to the first auxiliary frame portion and the first and second seat assemblies.

In some configurations, the auxiliary assembly includes a third actuator mounted to a seat platform of the second auxiliary frame portion and selectively moving the seat platform in the vertical direction relative to the first auxiliary frame portion and the first and second seat assemblies.

In some configurations, the second auxiliary frame portion includes a scissor linkage mounted to the seat platform and driven by the third actuator.

In some configurations, the furniture member includes a plurality of first legs and a plurality of second legs supporting the furniture member relative to the ground surface. The first legs may be attached to a frame of the first seat assembly. The second legs may be attached to a frame of the second seat assembly. The second legs may include wheels.

In some configurations, the first legs are lacking wheels. In other configurations, the first legs and the second legs include wheels.

In some configurations, each of the second legs includes a recess in which a portion of a corresponding one of the wheels is disposed.

In some configurations, the furniture member includes a plurality of intermediate rollers disposed between the plurality of first legs and the plurality of second legs. The intermediate rollers may be mounted to a frame of the second seat assembly.

In some configurations, the first seat assembly includes a first frame, the second seat assembly includes a second frame, and the auxiliary assembly includes an auxiliary frame. The first and second frames may include tracks in which the auxiliary frame is linearly movable to facilitate movement of the second seat assembly between the retracted and extended positions.

In another aspect, the present disclosure provides a furniture member that may include a first seat assembly and an auxiliary assembly. The first seat assembly may include a first seat bottom and a first seatback. The auxiliary assembly may be connected to the first seat assembly and may include an auxiliary seat bottom and an auxiliary seatback. The auxiliary assembly is movable between a stowed position and a deployed position. When the auxiliary assembly is in the stowed position, the auxiliary seat bottom is disposed vertically between the first seat bottom and a ground surface upon which the furniture member is disposed, and the auxiliary seatback is disposed rearward relative to the first seatback in a fore-aft direction that extends horizontally from a front end of the furniture member to a rear end of the furniture member (e.g., in the stowed position, the auxiliary seatback may be disposed horizontally between the first seatback and a rear end of the furniture member, and the first seatback may be disposed between the first seat bottom and the auxiliary seatback in the fore-aft direction). When the auxiliary assembly is in the deployed position, a seating surface of the auxiliary seat bottom is vertically level with a seating surface of the first seat bottom, and the auxiliary seatback is horizontally level with the first seatback in the fore-aft direction.

In another aspect, the present disclosure provides a furniture member that may include first and second seat assemblies and a center console assembly. The first seat assembly may include a first seat bottom and a first seatback. The second seat assembly may include a second seat bottom and a second seatback. The second seat assembly may be connected to the first seat assembly and movable relative to the first seat assembly between a retracted position in which the first seat bottom and the first seatback are adjacent to the second seat bottom and the second seatback, respectively, and an extended position in which the first seat bottom and the first seatback are spaced apart from the second seat bottom and the second seatback, respectively. The center console assembly may be connected to the first and second seat assemblies. The center console assembly may be movable between a stowed position in which the center console assembly is disposed vertically between a ground surface upon which the furniture member is disposed and the first and second seat assemblies and a deployed position in which the center console assembly is disposed laterally between the first and second seat assemblies and vertically higher than in the stowed position.

In some configurations, the center console assembly includes a cup holder and/or an armrest.

In some configurations, the center console assembly is movable to the deployed position only when the second seat assembly is in the extended position.

In some configurations, the second seat assembly is movable to the retracted position only when the center console assembly is the stowed position.

In some configurations, the furniture member includes a first actuator attached to the first and second seat assemblies and selectively moving the second seat assembly relative to the first seat assembly between the retracted and extended positions.

In some configurations, the center console assembly includes an auxiliary frame including a first auxiliary frame portion and a second auxiliary frame portion that is movable relative to the first auxiliary frame portion.

In some configurations, the first auxiliary frame portion is mounted to the first and second seat assemblies and movable relative to the first and second seat assemblies in a lateral direction as the second seat assembly moves between the retracted and extended positions.

In some configurations, the second auxiliary frame portion is mounted to the first auxiliary frame portion for movement relative to the first auxiliary frame portion in a vertical direction and in a fore-aft direction. The vertical direction is perpendicular to the lateral direction, and the fore-aft direction is perpendicular to the lateral direction and the vertical direction.

In some configurations, the center console assembly includes a second actuator mounted to the first and second auxiliary frame portions and selectively moving the second auxiliary frame portion in the fore-aft direction relative to the first auxiliary frame portion and the first and second seat assemblies.

In some configurations, the center console assembly includes a third actuator mounted to the second auxiliary frame portion and selectively moving the second auxiliary frame portion in the vertical direction relative to the first auxiliary frame portion and the first and second seat assemblies.

In some configurations, the second auxiliary frame portion includes a scissor linkage driven by the third actuator.

In some configurations, the furniture member includes a plurality of first legs and a plurality of second legs supporting the furniture member relative to the ground surface. The first legs may be attached to a frame of the first seat assembly. The second legs may be attached to a frame of the second seat assembly. The second legs may include wheels.

In some configurations, each of the second legs includes a recess in which a portion of a corresponding one of the wheels is disposed.

In some configurations, the furniture member includes a plurality of intermediate rollers disposed between the plurality of first legs and the plurality of second legs. The intermediate rollers may be mounted to a frame of the second seat assembly.

In some configurations, the first seat assembly includes a first frame, the second seat assembly includes a second frame, and the center console assembly includes an auxiliary frame. The first and second frames may include tracks in which the auxiliary frame is linearly movable to facilitate movement of the second seat assembly between the retracted and extended positions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 17:
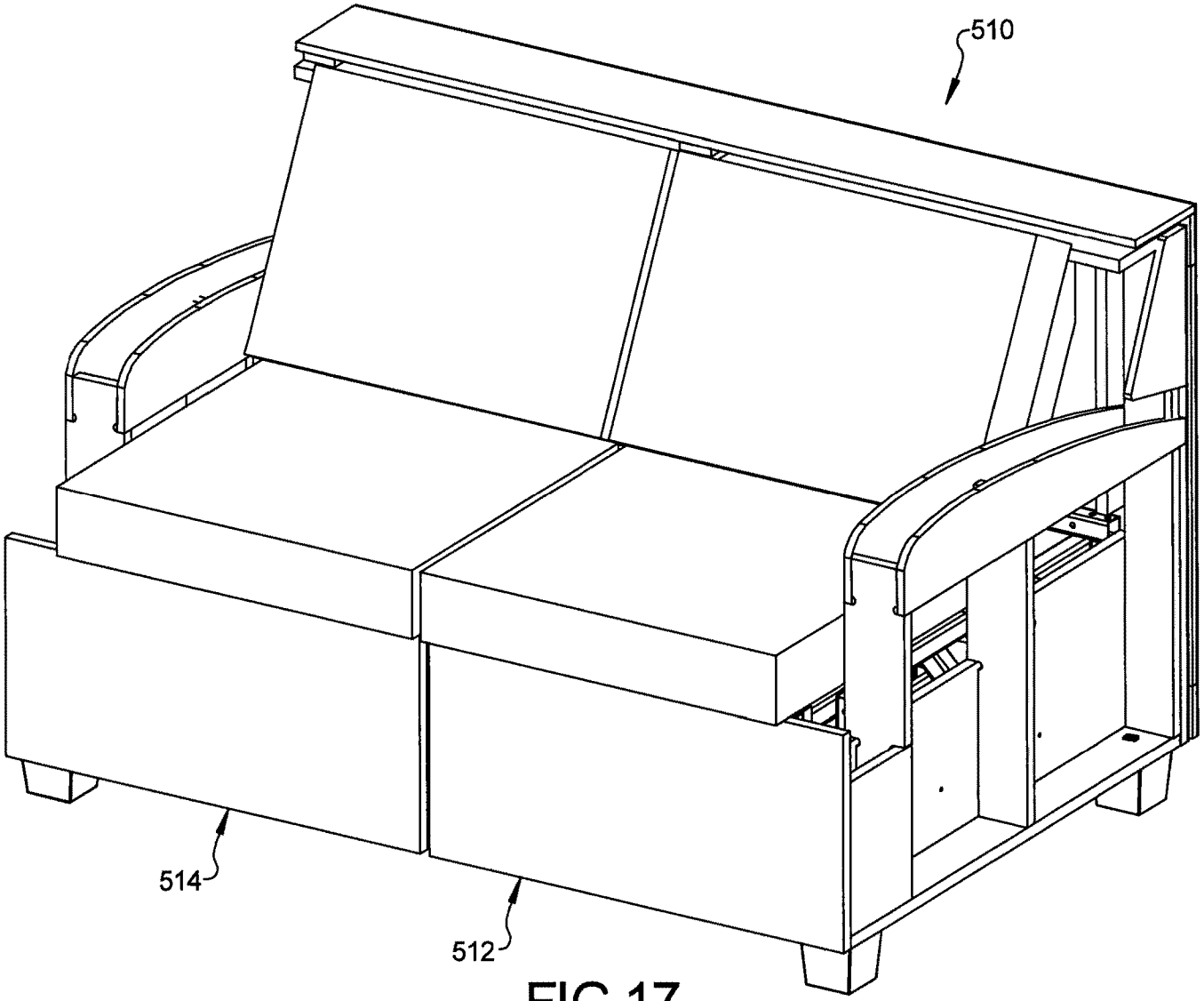
FIG. 17 is a perspective view of another furniture member in a first configuration in which first and second seat assemblies are in a retracted position and an auxiliary assembly is in a stowed position according to the principles of the present disclosure.
Figure 18:
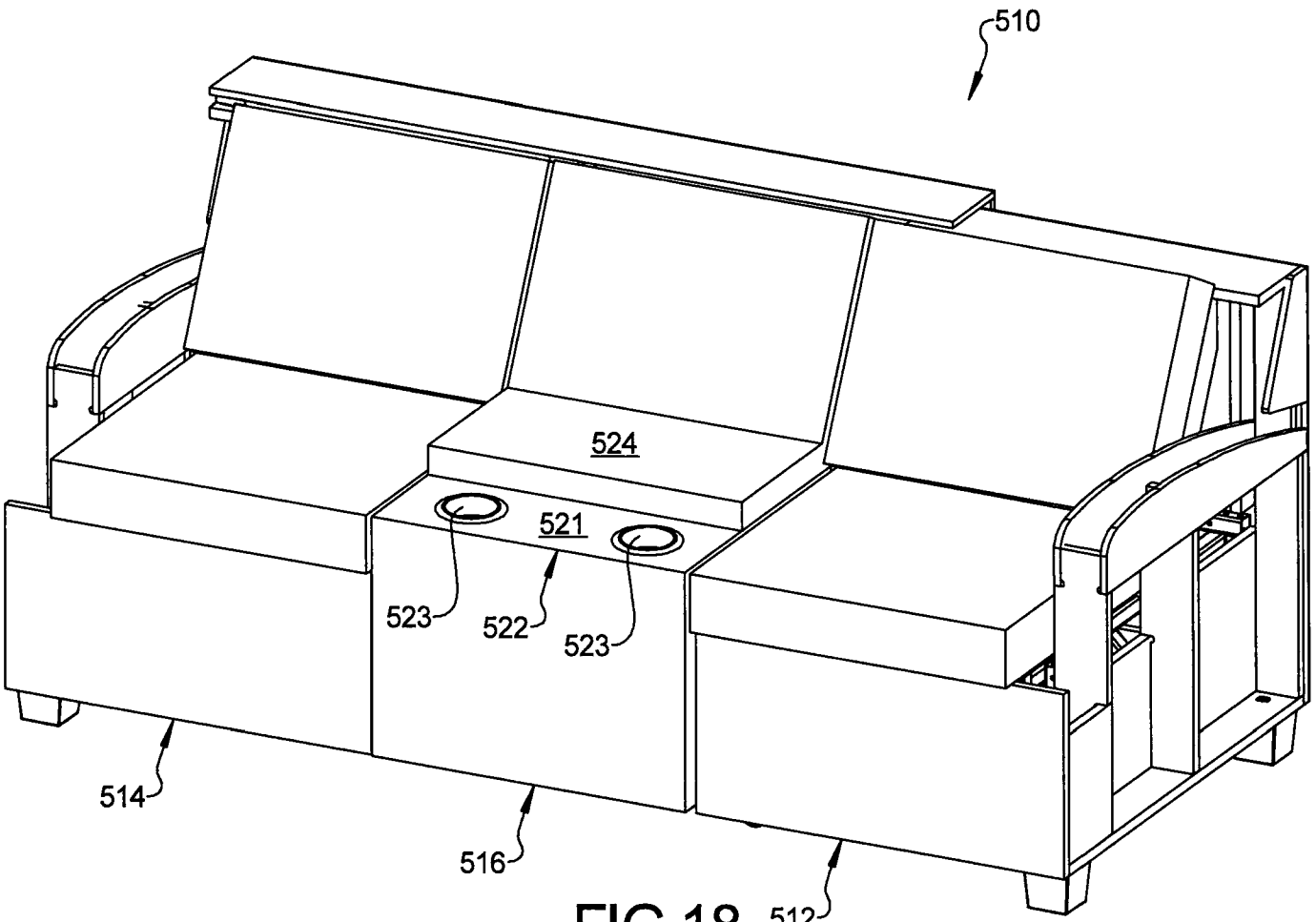
Figure 19:
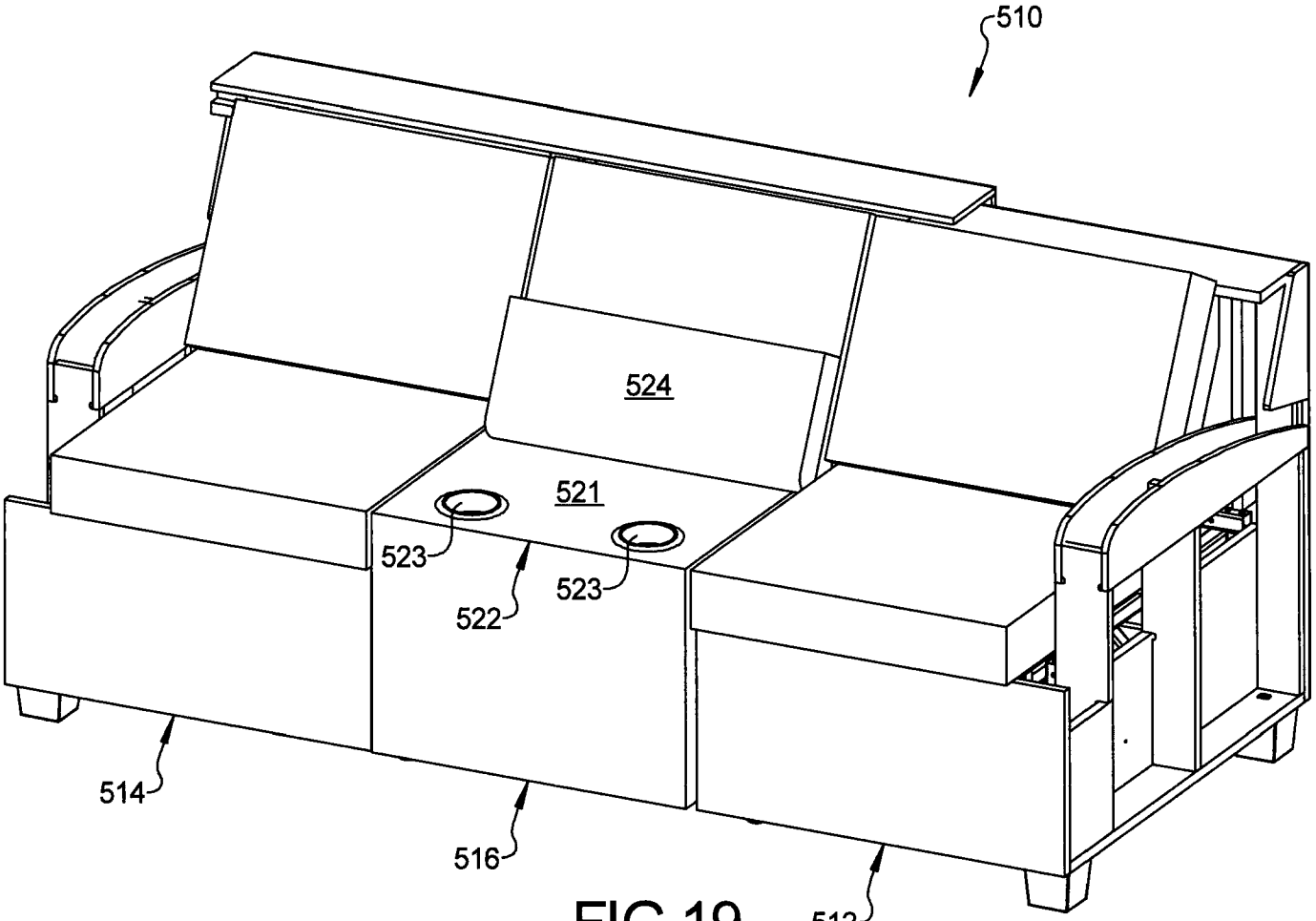

FIG. 18 is a perspective view of the furniture member of FIG. 17 in another configuration in which the first and second seat assemblies are in an extended position and the auxiliary assembly is in a deployed position with an armrest of the auxiliary assembly rotated down; and FIG. 19 is a perspective view of the furniture member of FIG. 17 in another configuration in which the first and second seat assemblies are in the extended position and the auxiliary assembly is in the deployed position with the armrest rotated up.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
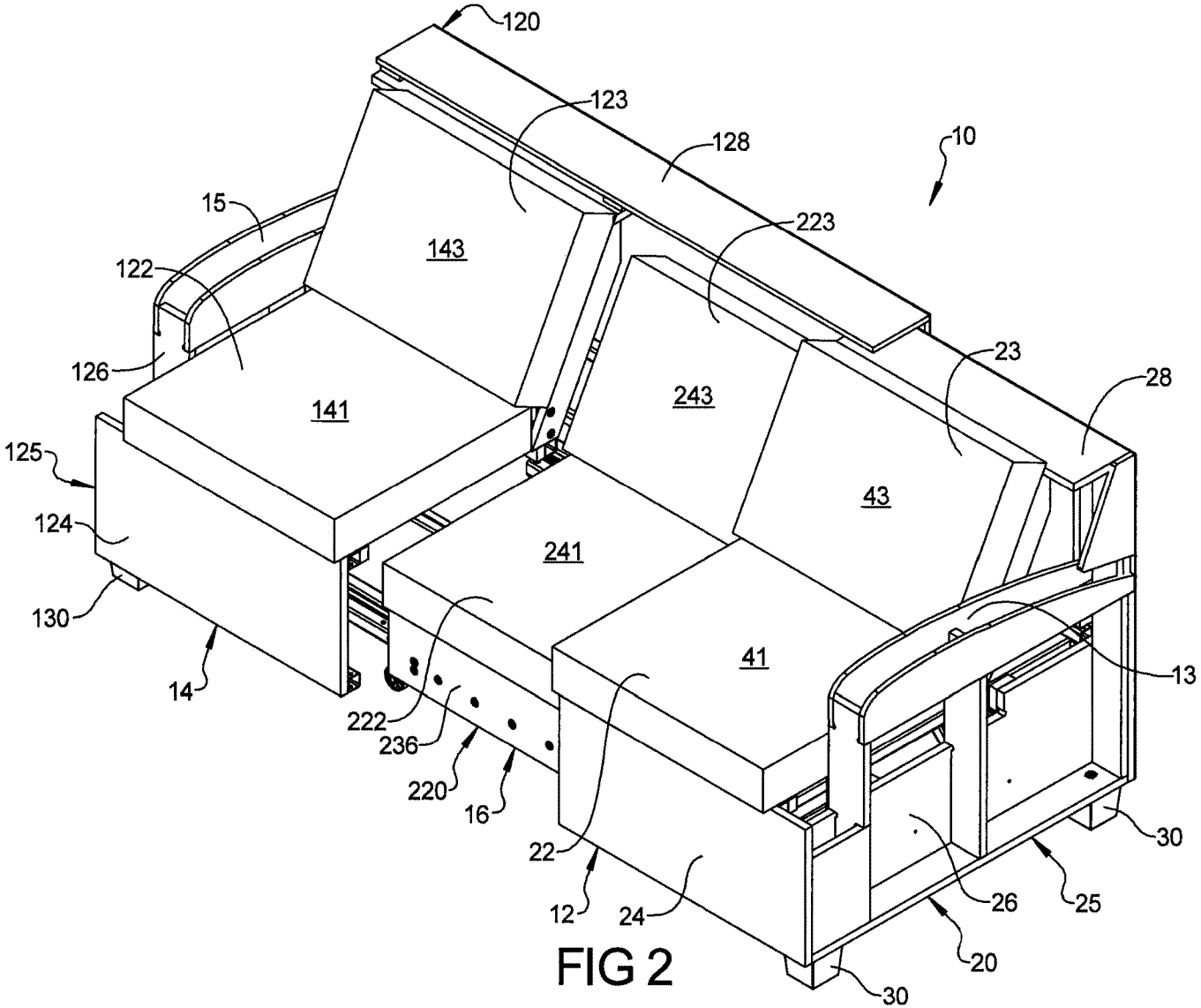
FIG. 2 is a perspective view of the furniture member of FIG. 1 with the first and second seat assemblies in an extended position and the auxiliary assembly is in the stowed position.
Figure 3:
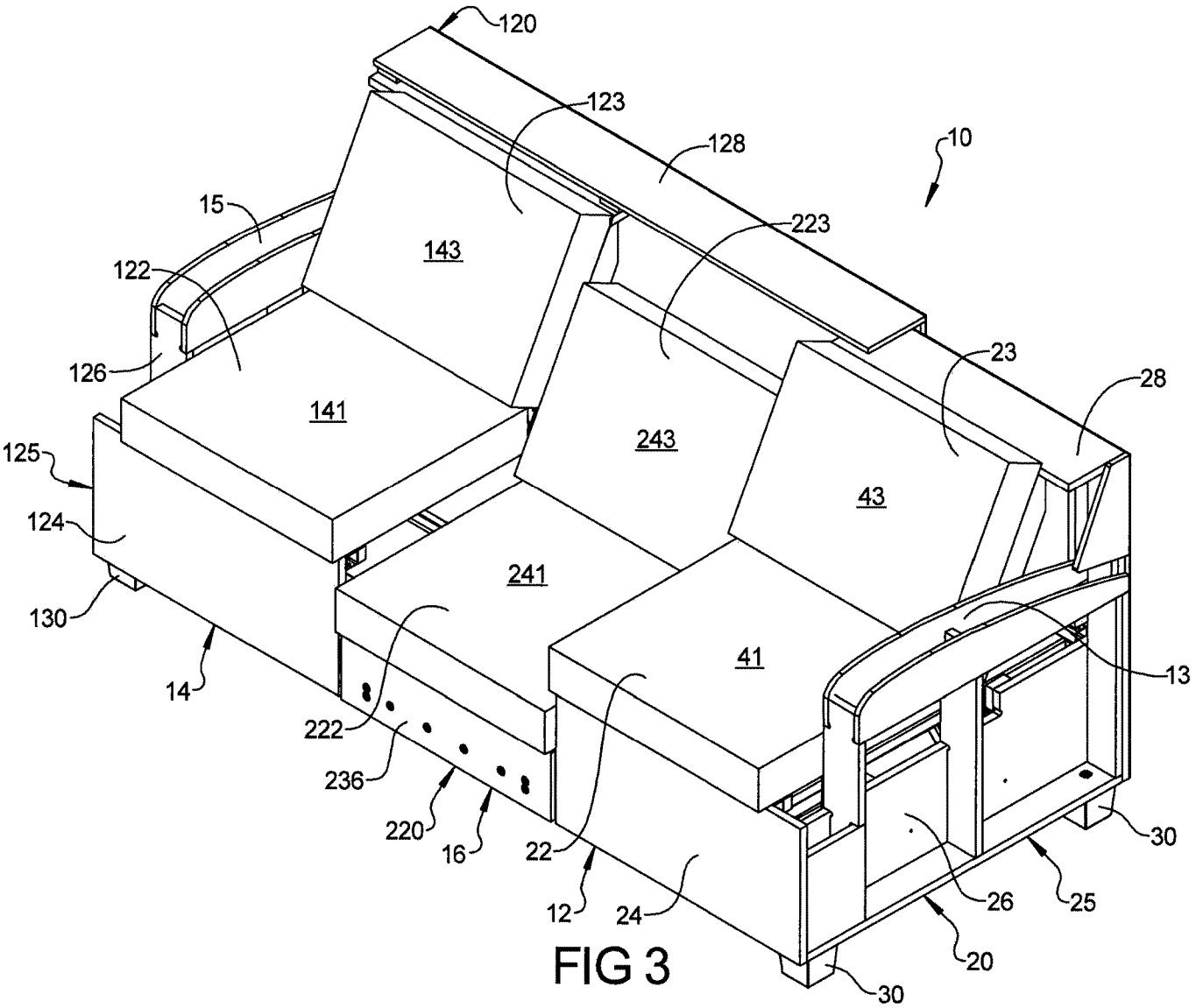
FIG. 3 is a perspective view of the furniture member of FIG. 1 with the first and second seat assemblies in the extended position and the auxiliary assembly moved forward from the stowed position.
Figure 4:
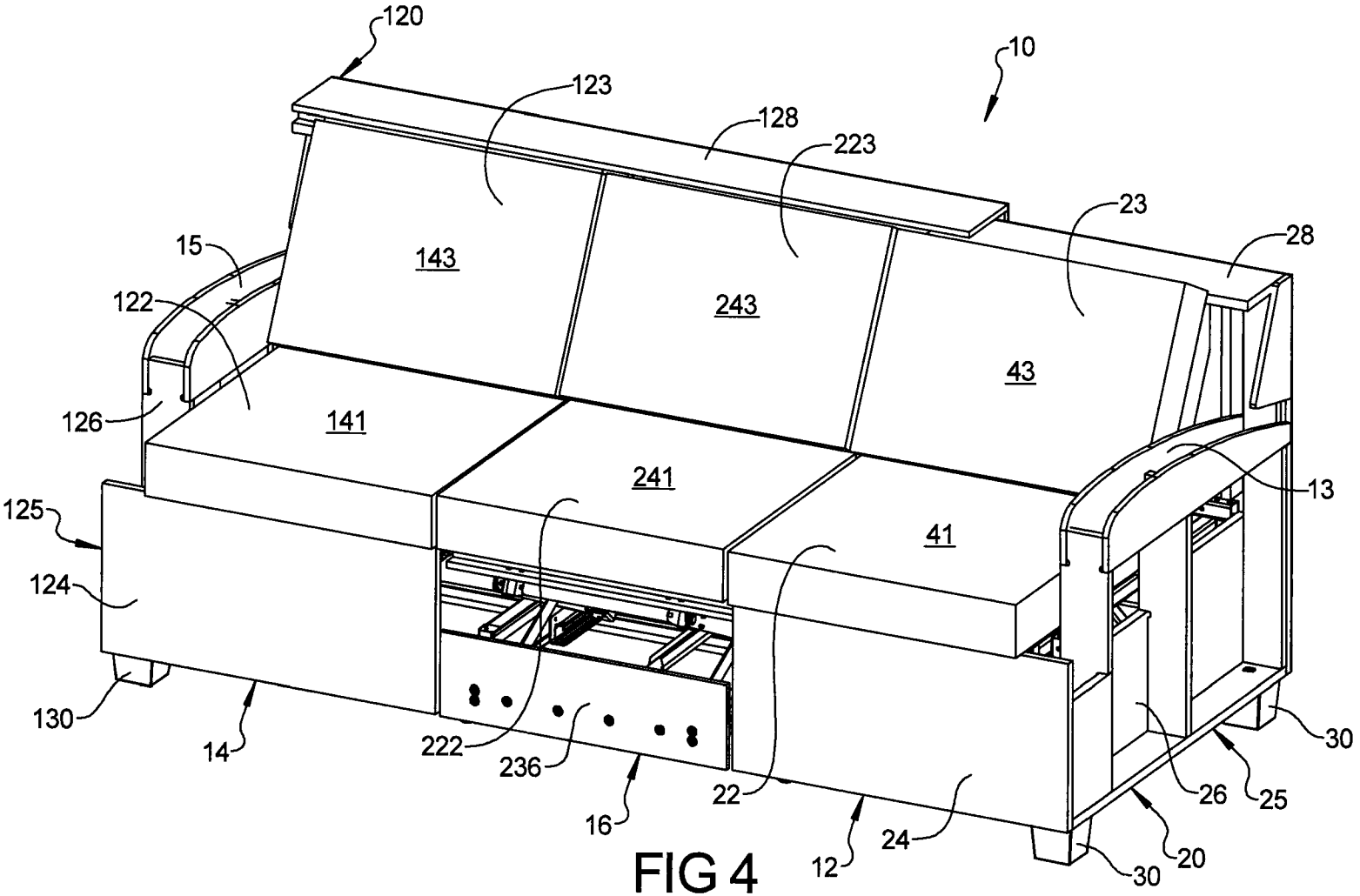
FIG. 4 is a perspective view of the furniture member of FIG. 1 in a second seating configuration in which with the first and second seat assemblies are in the extended position and the auxiliary assembly is in the deployed position.

With reference to FIGS. 1-16, a furniture member 10 is provided that may include a first seat assembly 12, a second seat assembly 14, and an auxiliary assembly (e.g., an auxiliary seat assembly) 16. The second seat assembly 14 is movable relative to the first seat assembly 12 between a retracted position (FIG. 1) and an extended position (FIGS. 2-4). The auxiliary assembly 16 is movable relative to the first and second seat assemblies 12, 14 between a stowed position (FIGS. 2 and 11-13) and a deployed position (FIGS. 4 and 14-16).

Figure 1:
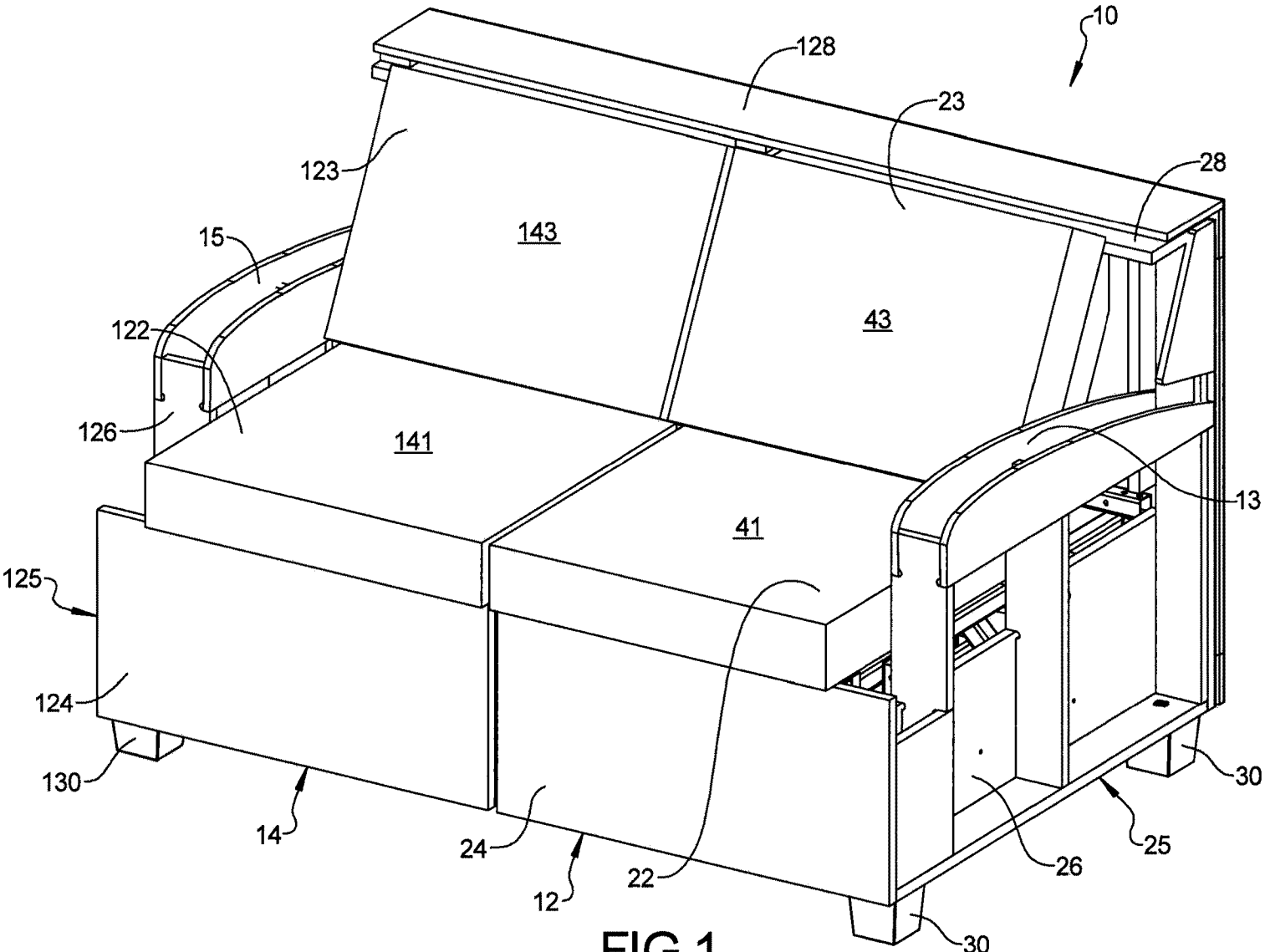
FIG. 1 is a perspective view of a furniture member in a first seating configuration in which first and second seat assemblies are in a retracted position and an auxiliary assembly is in a stowed position according to the principles of the present disclosure.

As shown in FIG. 1, when the second seat assembly 14 is in the retracted position and the auxiliary assembly 16 is in the stowed position, the furniture member 10 has a first seating capacity (i.e., a first seating length between first and second armrests 13, 15 of the first and second seat assemblies 12, 14). As shown in FIG. 4, when the second seat assembly 14 is in the extended position and the auxiliary assembly 16 is in the deployed position, the furniture member 10 has a second seating capacity (i.e., a second seating length between first and second armrests 13, 15 of the first and second seat assemblies 12, 14) that is greater than the first seating capacity. That is, when the furniture member 10 is movable between the configuration shown in FIG. 1, in which only two seating assemblies 12, 14 are available for one or more users to occupy, and the configuration shown in FIG. 4, in which three seat assemblies 12, 14, 16 are available for the one or more users to occupy. Movement between these configurations allows the furniture member 10 to be more compact in size (i.e., to occupy less space within a room) when desired by the user(s) and also allows the furniture member 10 to provide more seating capacity (to allow for space for more users to sit on the furniture member 10 or to provide more space for one or more users to lay on the furniture member 10) when desired by the user(s).

Figure 11:
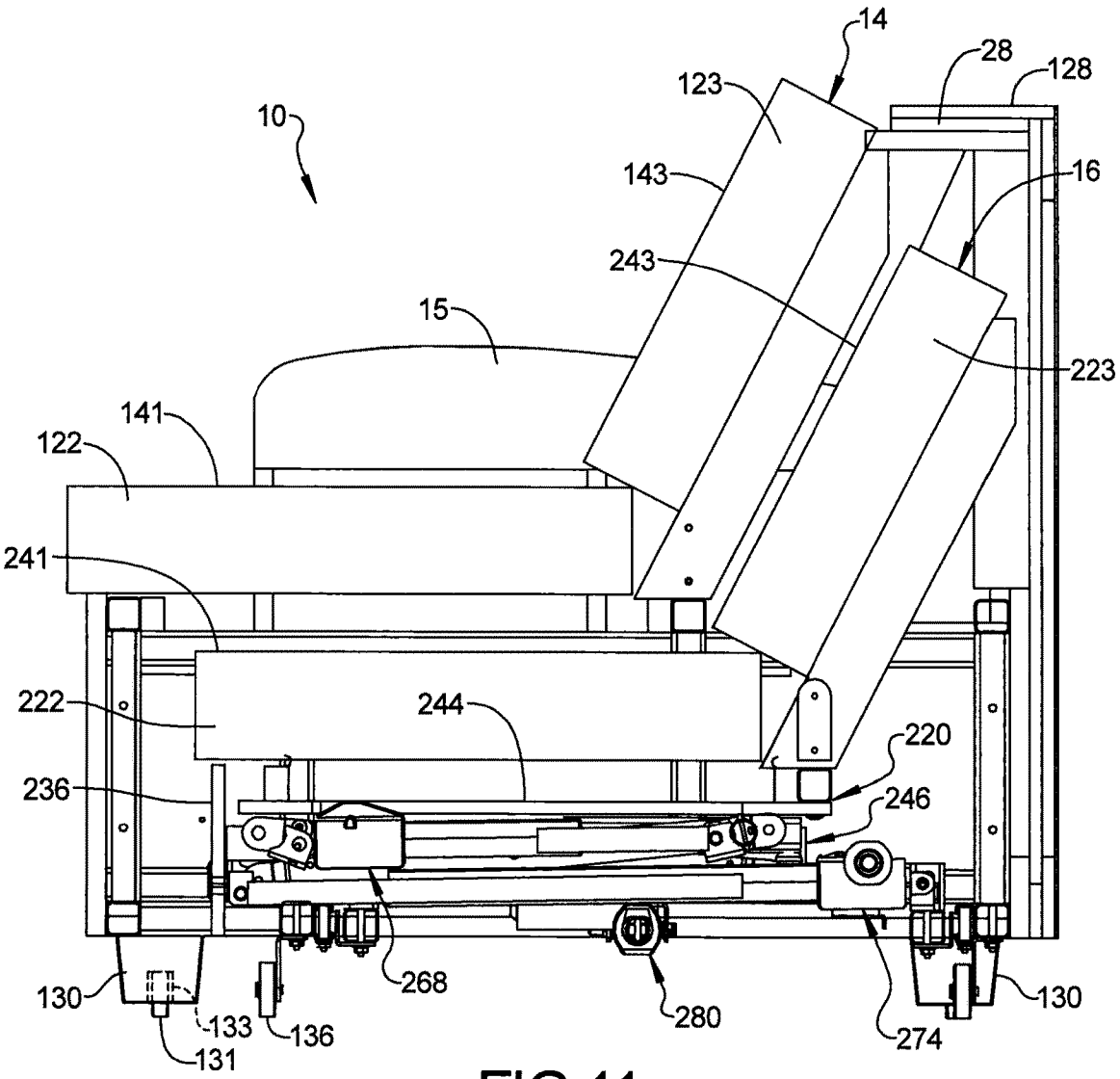
FIG. 11 is a partial side view of the furniture member with the auxiliary assembly in the stowed position.

The first seat assembly 12 may include a first frame 20 (see, e.g., FIGS. 2 and 15), a first seat bottom 22 (see, e.g., FIGS. 1-4), and a first seatback 23 (see, e.g., FIGS. 1-4). The first frame 20 may include an outer panel assembly 25 (FIGS. 2 and 15) and an interior support frame 27 (FIGS. 5, 6 and 15) fixedly mounted to the outer panel assembly 25. The outer panel assembly 25 may include a front outer panel 24, a side outer panel 26, and one or more rear outer panels 28. The front outer panel 24 may be disposed at a front end of the furniture member 10 or the front outer panel 24 may define the front end of the furniture member 10. As shown in FIG. 11, the rear outer panel 28 may be generally L-shaped and may define or be disposed near a vertically top end of the furniture member 10 and a rear end of the furniture member 10. The front and rear outer panels 24, 28 may be fixedly attached to the side outer panel 26. The side outer panel 26 may include the first armrest 13 and a pair of legs 30. The legs 30 support the furniture member 10 relative to a ground surface on which the furniture member is disposed. In some configurations, the legs 30 may include wheels or casters that can roll along the ground surface. In other configurations, the legs 30 do not have wheels. The outer panel assembly 25 and the interior support frame 27 may cooperate to support the first seat bottom 22 and the first seatback 23.

Figure 5:
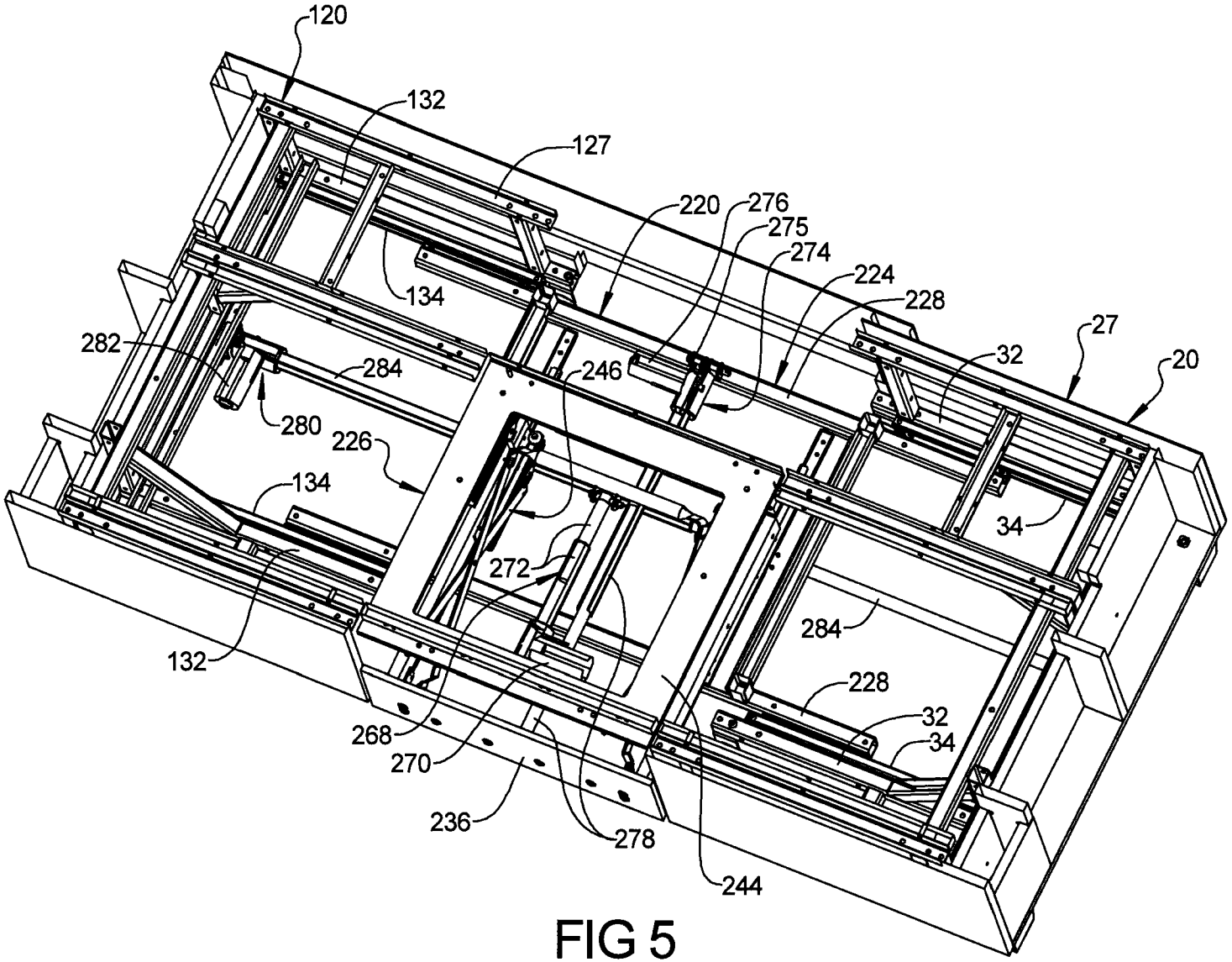
FIG. 5 is a perspective view of a portion of the furniture member in the second seating configuration.
Figure 6:
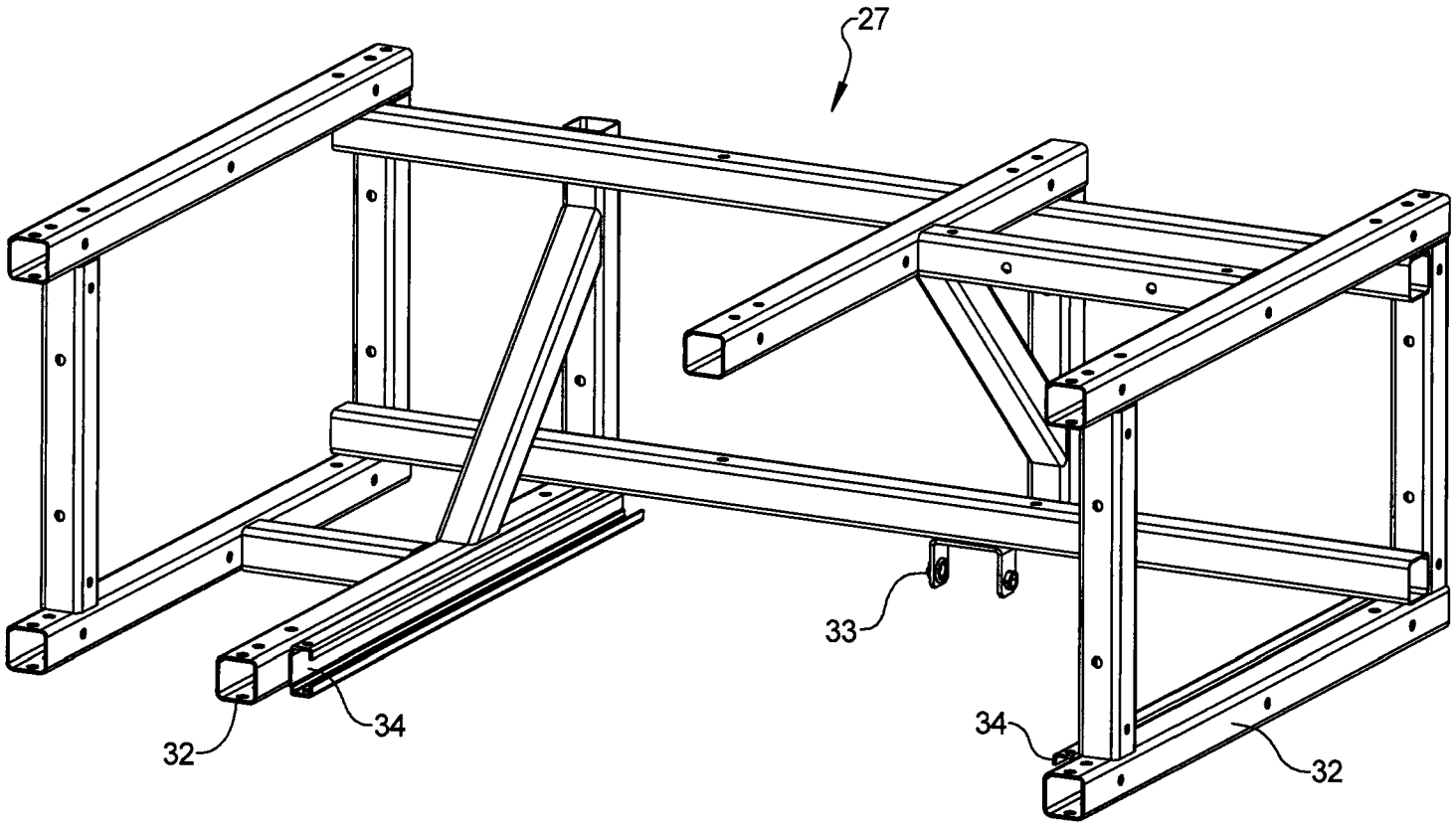
FIG. 6 is a perspective view of a frame of the first seat assembly.

As shown in FIGS. 5 and 6, a pair of lateral support members 32 of the interior support frame 27 may include channels or tracks 34 that slidably engage the auxiliary assembly 16, as will be described in more detail below. In some configurations, the lateral support members 32 may include intermediate rollers or wheels 36 (FIG. 16) that can roll along the ground surface on which the furniture member is disposed and assist in bearing the weight of the furniture member 10. While the first seat bottom 22 and the first seatback 23 shown in the figures are fixedly attached to the first frame 20, in some configurations, the first seat bottom 22 and the first seatback 23 may be movable relative to the first frame 20 (e.g., between reclined and upright positions). Furthermore, in some configurations, the first seat assembly 12 could include an extendable legrest assembly.

The second seat assembly 14 may be similar in construction to the first seat assembly 12 (e.g., substantially a mirror image of the first seat assembly 12). That is, the second seat assembly 14 may include a second frame 120 (see, e.g., FIGS. 2 and 15), a second seat bottom 122 (see, e.g., FIGS. 1-4), and a second seatback 123 (see, e.g., FIGS. 1-4). The second frame 120 may include an outer panel assembly 125 (FIGS. 2 and 15) and an interior support frame 127 (FIGS. 5, 7 and 15) fixedly mounted to the outer panel assembly 125. The outer panel assembly 125 may include a front outer panel 124, a side outer panel 126, and one or more rear outer panels 128. The front outer panel 124 may be disposed at a front end of the furniture member 10 or the front outer panel 124 may define the front end of the furniture member 10. As shown in FIG. 11, the rear outer panel 128 may be generally L-shaped and may define or be disposed near a vertically top end of the furniture member 10 and a rear end of the furniture member 10. The front and rear outer panels 124, 128 may be fixedly attached to the side outer panel 126. The side outer panel 126 may include the second armrest 15 and a pair of legs 130. The legs 130 (in cooperation with the legs 30 of the first frame 20) support the furniture member 10 relative to the ground surface on which the furniture member is disposed. In some configurations, the legs 30 may include casters or wheels 131 that can roll along the ground surface. As shown in FIG. 11, the wheels 131 may be partially received within a cavity or recess 133 formed in the bottom of the legs 130. The outer panel assembly 125 and the interior support frame 127 may cooperate to support the second seat bottom 122 and the second seatback 123.

Figure 12:
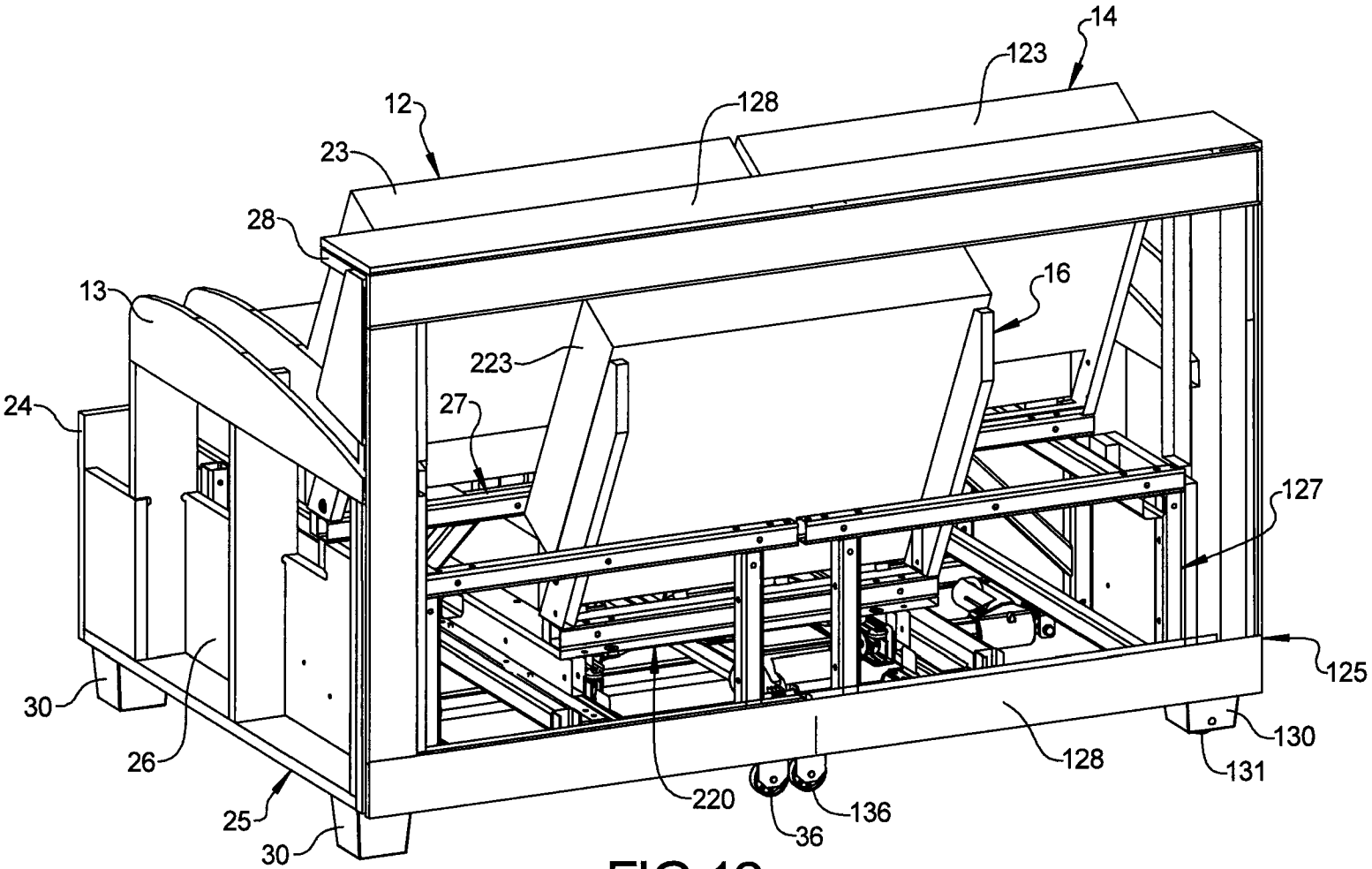
FIG. 12 is another perspective view of the furniture member in the first seating configuration shown in FIG. 1.
Figure 15:
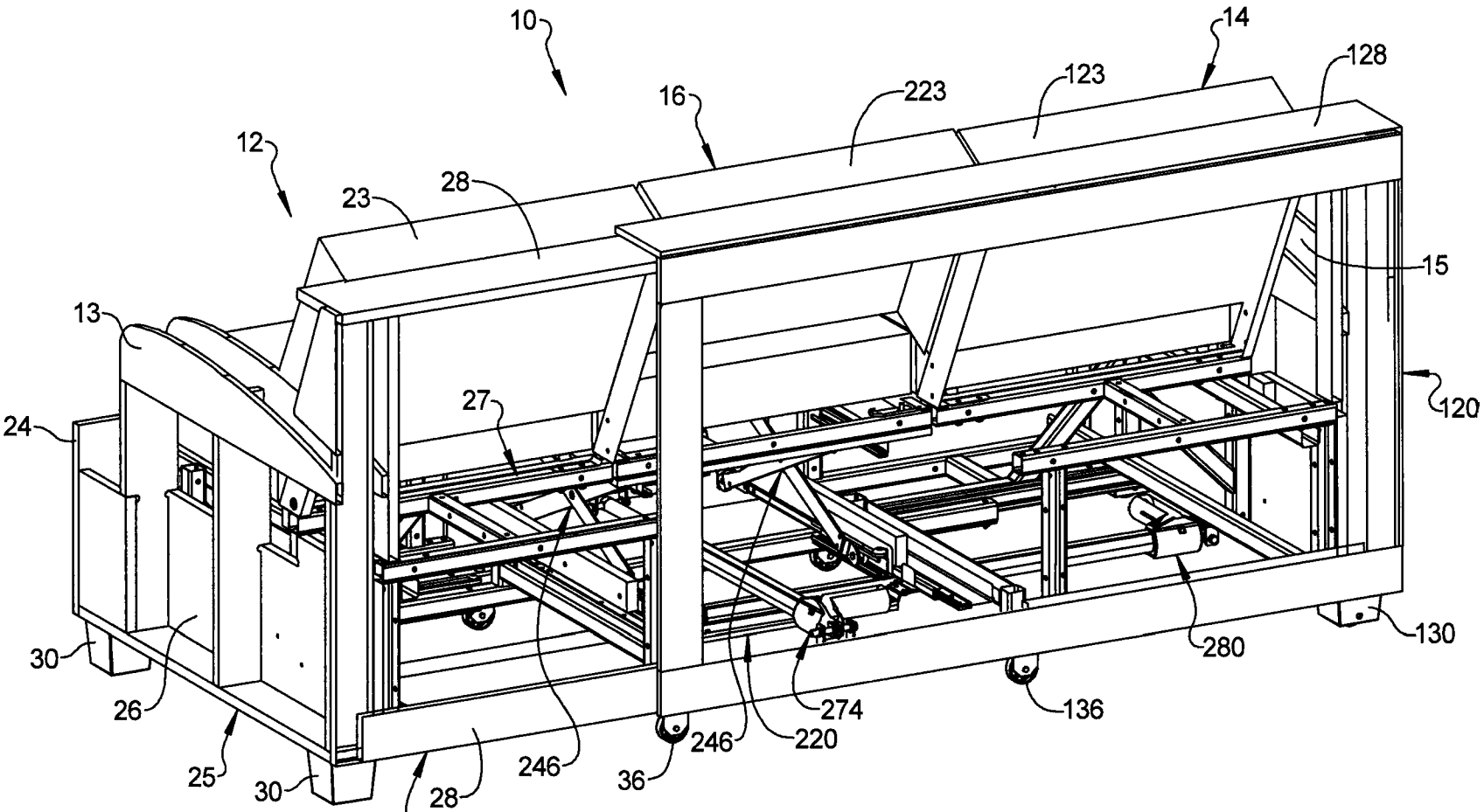
FIG. 15 is another perspective view of the furniture member in the second seating configuration shown in FIG. 4.

As shown in FIGS. 1 and 12, when the second seat assembly 14 is in the retracted position, the rear outer panels 28 of the first frame 20 may be disposed underneath and/or in front of the rear outer panels 128 of the second frame 120. That is, the rear outer panels 28 may be substantially (mostly or entirely) covered by the rear outer panels 128 (i.e., the rear outer panels 28 may be disposed between the first seatback 23 and the rear outer panels 128) when the second seat assembly 14 is in the retracted position. When the second seat assembly 14 is in the extended position, the outer rear panels 28 of the first frame 20 are substantially (mostly or entirely) exposed, as shown in FIGS. 2 and 15.

Figure 7:
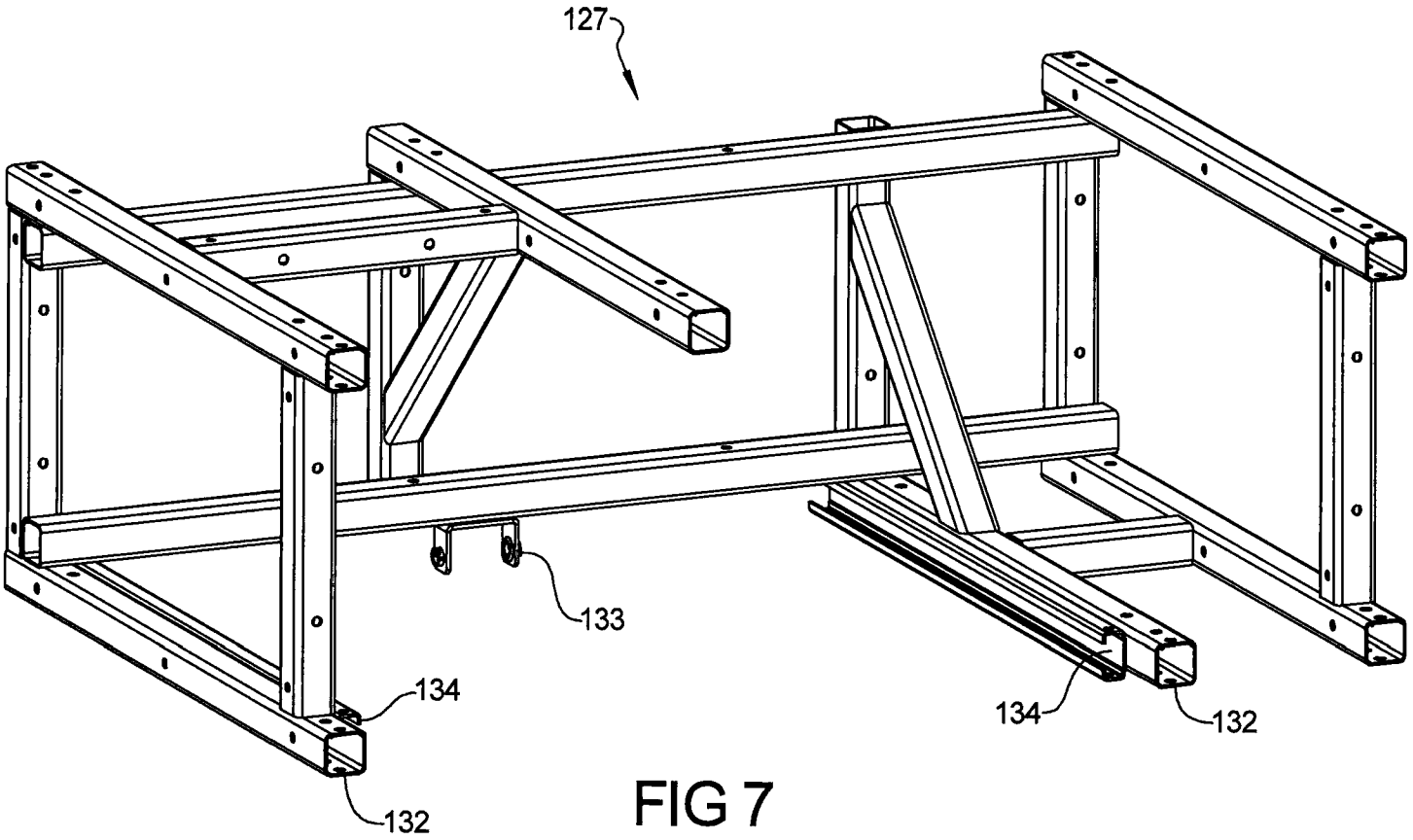
FIG. 7 is a perspective view of a frame of the second seat assembly.

As shown in FIGS. 5 and 7, a pair of lateral support members 132 of the interior support frame 127 of the second frame 120 may include channels or tracks 134 that slidably engage the auxiliary assembly 16, as will be described in more detail below. In some configurations, the lateral support members 132 may include intermediate rollers or wheels 136 (FIG. 16) that can roll along the ground surface on which the furniture member is disposed and assist in bearing the weight of the furniture member 10. While the second seat bottom 122 and the second seatback 123 shown in the figures are fixedly attached to the second frame 120, in some configurations, the second seat bottom 122 and the second seatback 123 may be movable relative to the second frame 120 (e.g., between reclined and upright positions). Furthermore, in some configurations, the second seat assembly 14 could include an extendable legrest assembly.

Figure 14:
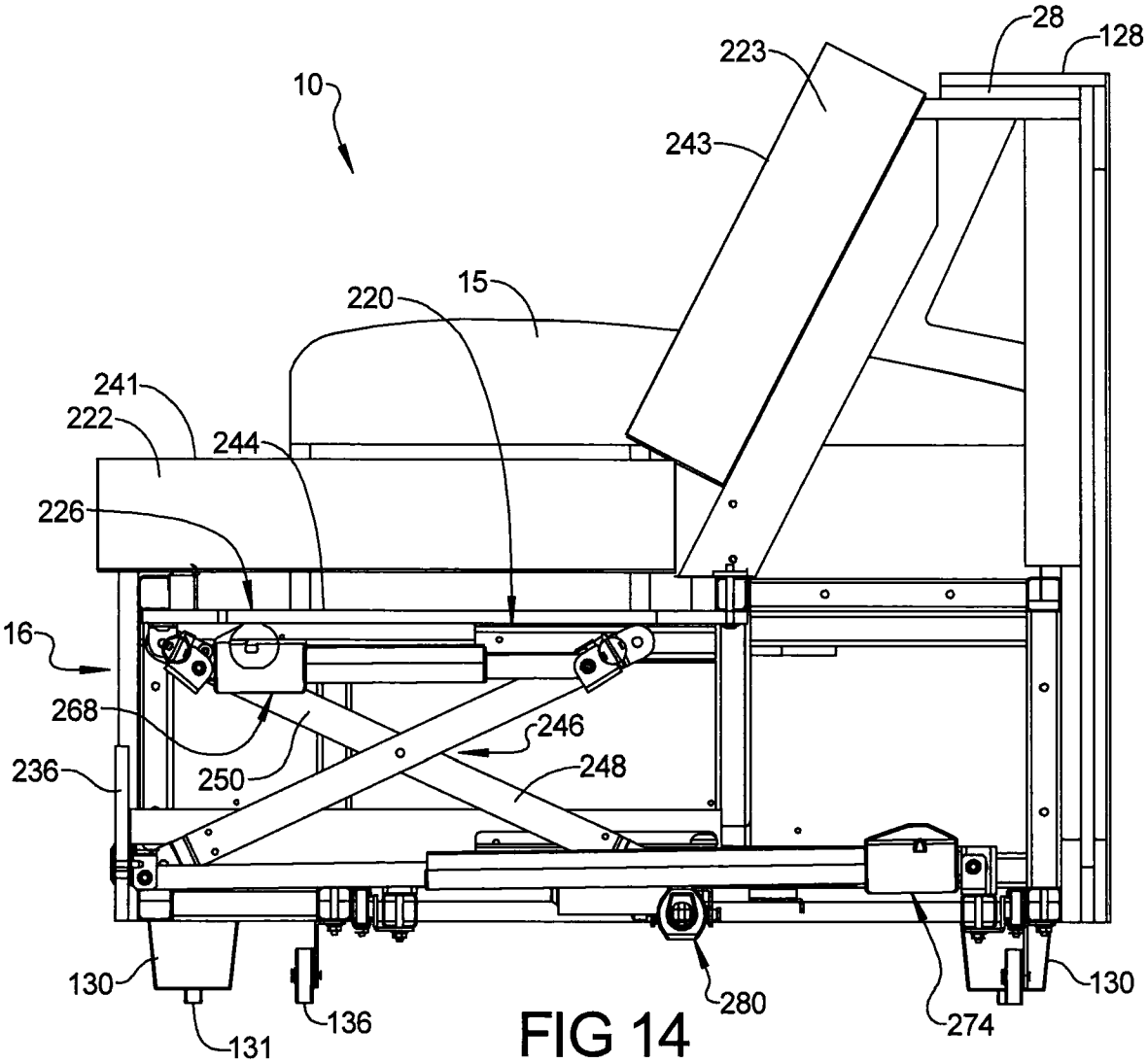
FIG. 14 is a partial side view of the furniture member with the auxiliary assembly in the deployed position.

As shown in FIGS. 11 and 14, the auxiliary assembly 16 may include an auxiliary frame 220, a third seat bottom 222, and a third seatback 223. The third seat bottom 222 and the third seatback 223 are mounted on the auxiliary frame 220. The auxiliary frame 220 is movably mounted to the first and second frames 20, 120 to allow for relative movement among the auxiliary assembly 16, the first seat assembly 12 and the second seat assembly 14. The auxiliary frame 220 may include a first auxiliary frame portion 224 (FIG. 8) and a second auxiliary frame portion 226 (FIGS. 9 and 10) that is movable relative to the first auxiliary frame portion 224.

Figure 8:
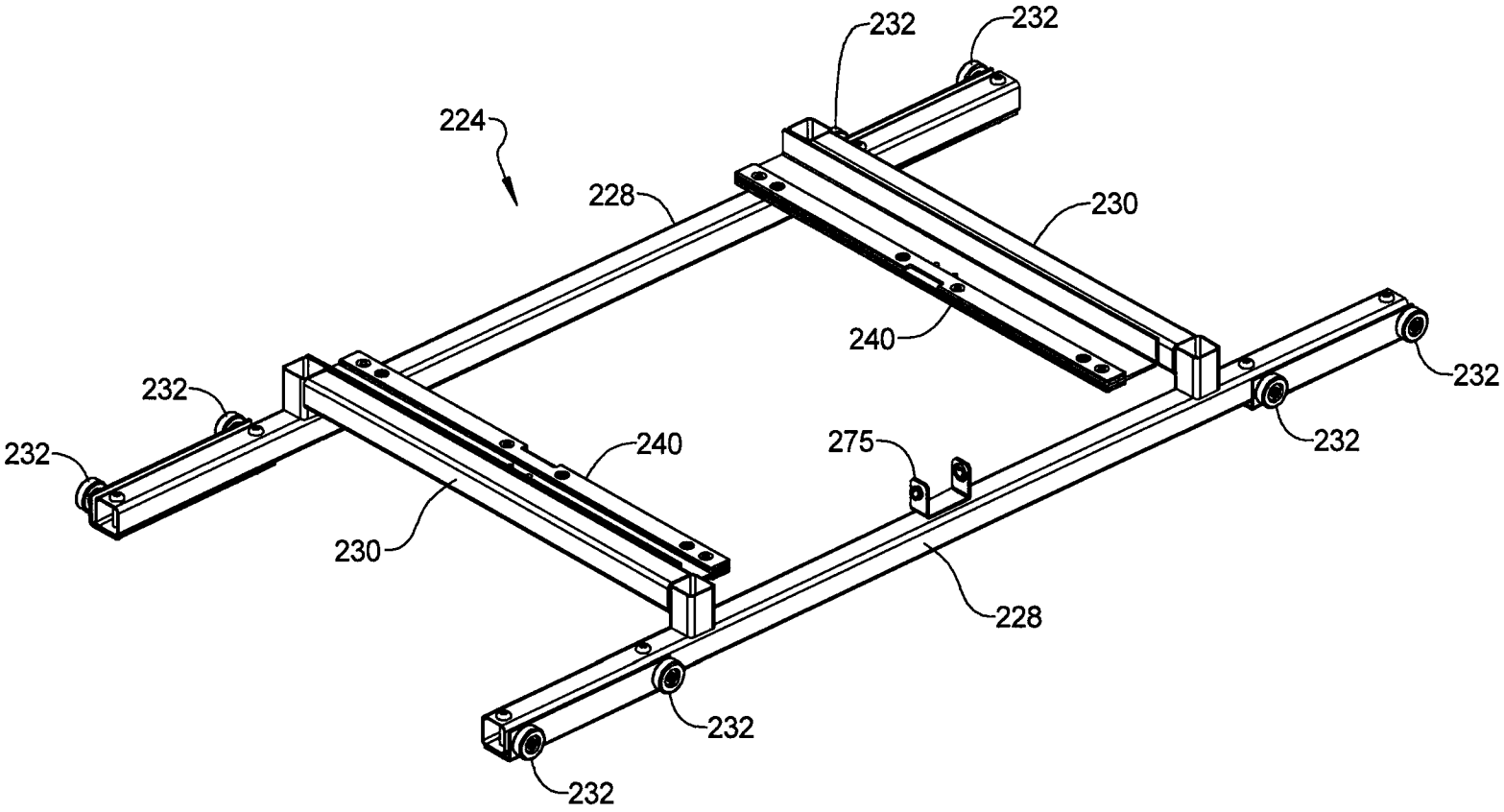
FIG. 8 is a perspective view of a first portion of a frame of the auxiliary assembly.
Figure 13:
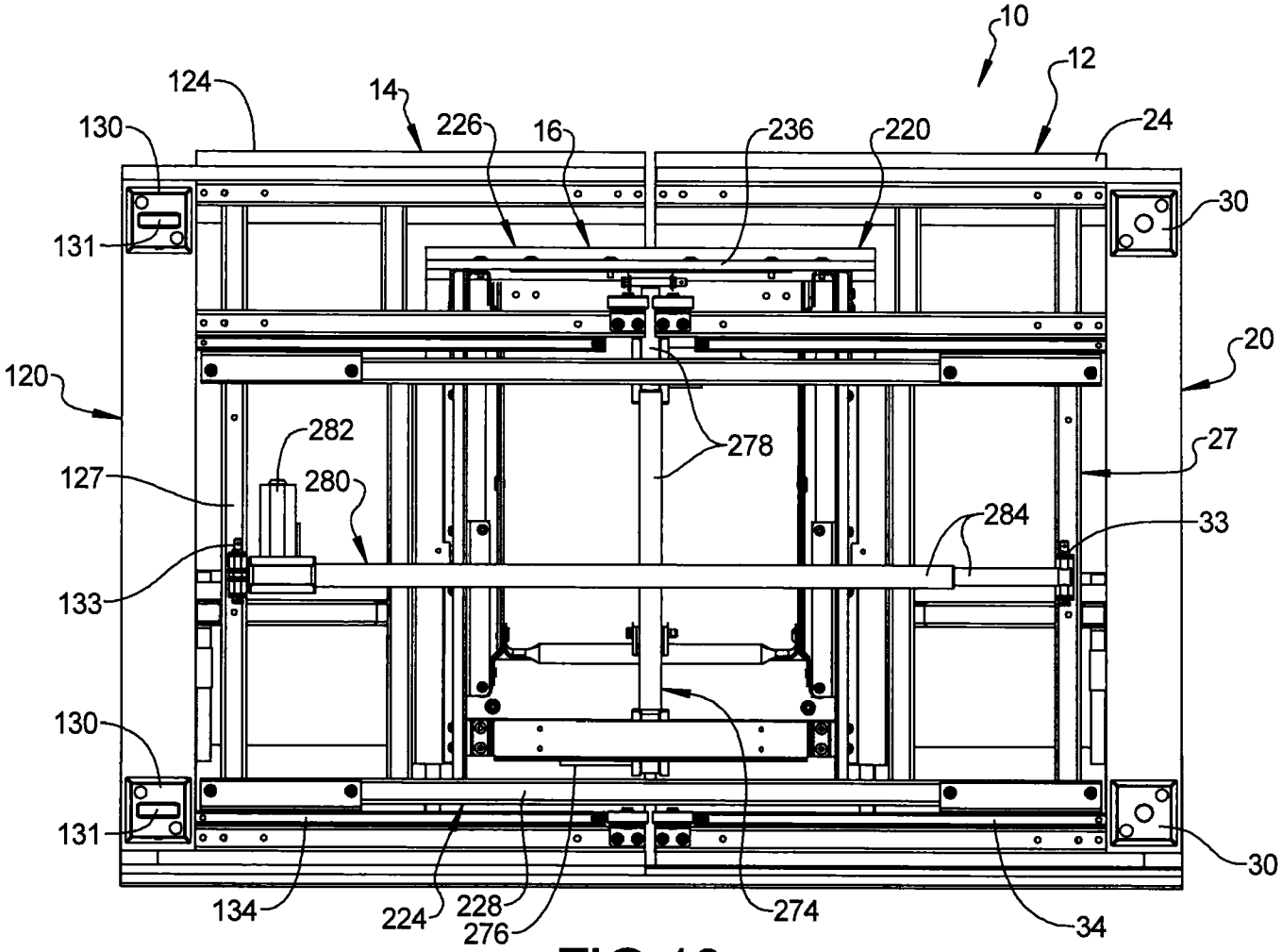
FIG. 13 is a bottom view of the furniture member in the first seating configuration shown in FIG. 1.
Figure 16:
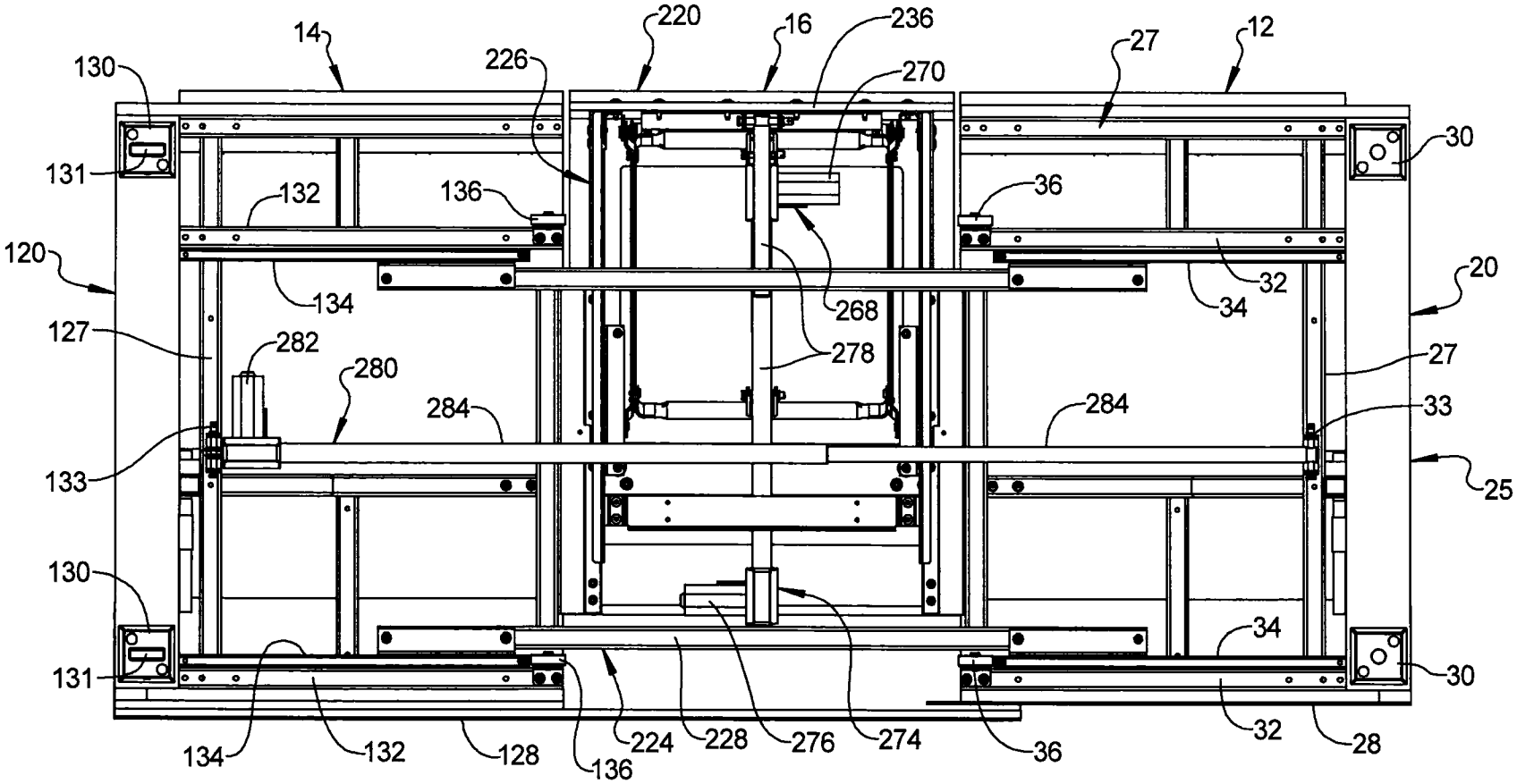
FIG. 16 is a bottom view of the furniture member in the second seating configuration shown in FIG. 4.

As shown in FIG. 8, the first auxiliary frame portion 224 may include a pair of lateral support members 228 and a pair of fore-aft support members 230 that extend between and are fixedly attached to the lateral support members 228. Both ends of each of the lateral support members 228 may include one or more wheels or rollers 232. As shown in FIGS. 5, 13 and 16, the wheels 232 of the lateral support members 228 may be received in the tracks 34, 134 of the first and second frames 20, 120. In this manner, the auxiliary frame 220, and thus, the third seat bottom 222 and third seatback 223, are able to move in a lateral direction (i.e., along a line that spans from the first armrest 13 to the second armrest 15) relative to the first and second frames 20, 120, the first and second seat bottoms 22, 122, and the first and second seatbacks 23, 123.

Figure 9:
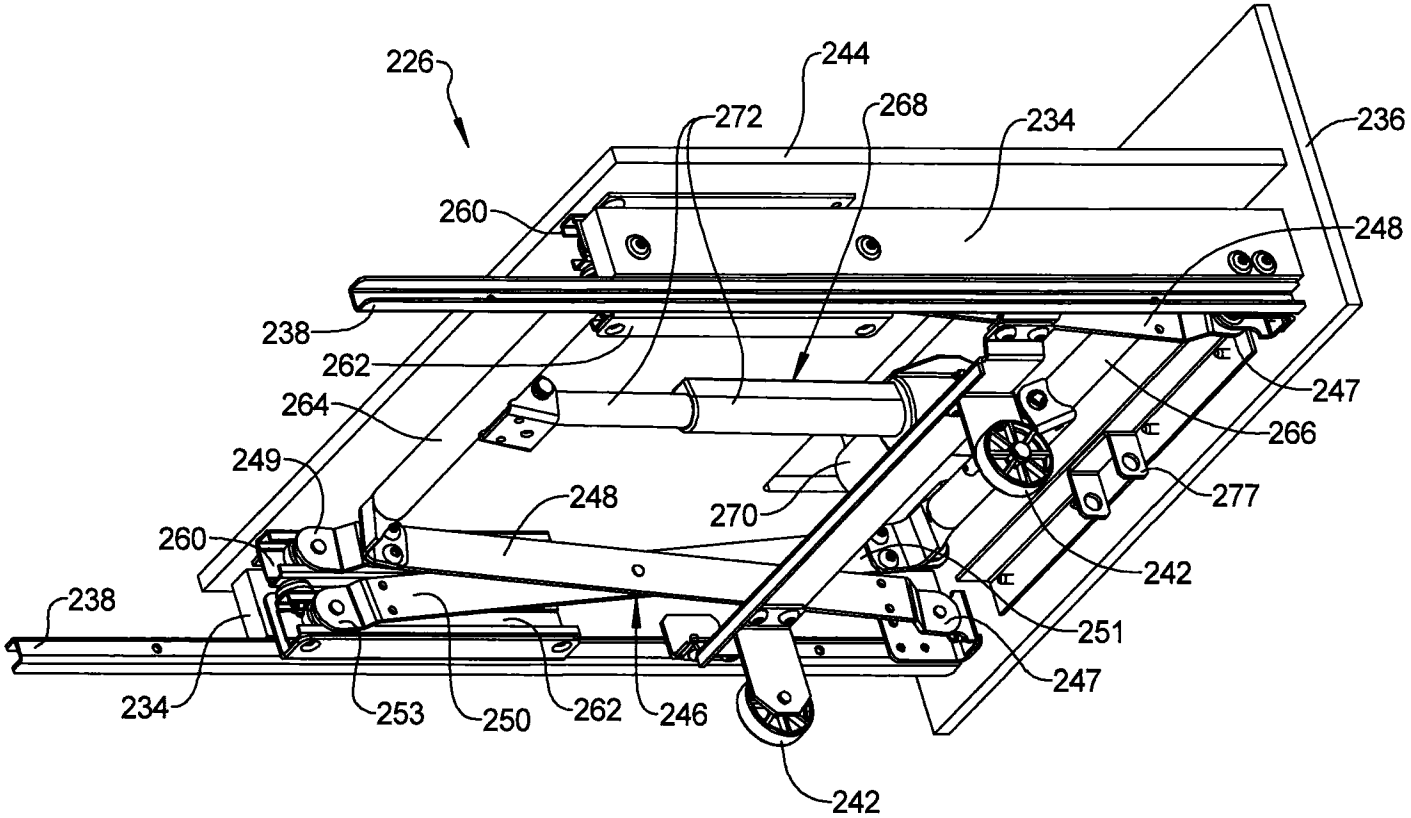
FIG. 9 is a perspective view of a second portion of the frame of the auxiliary assembly in a vertically lowered position.
Figure 10:
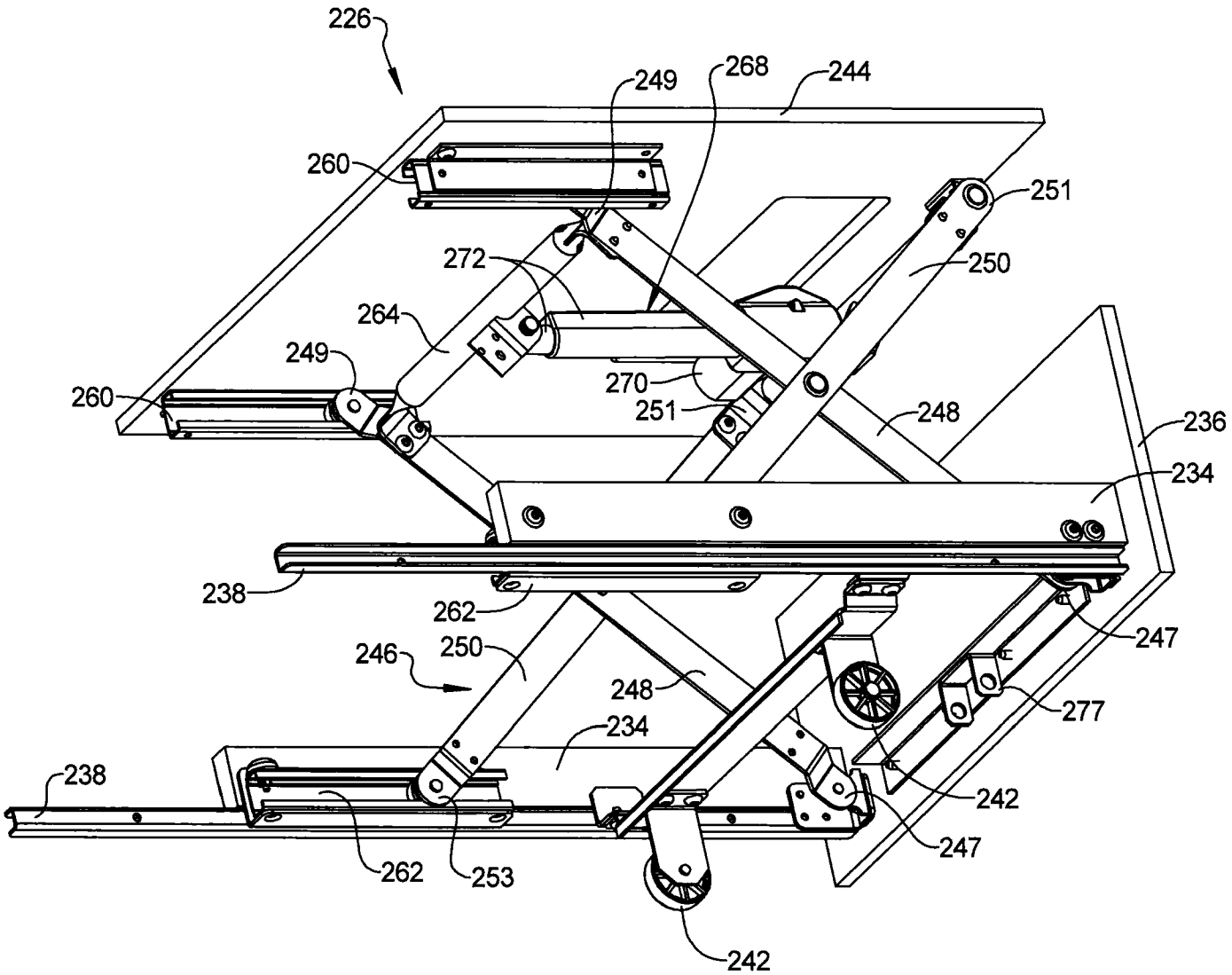
FIG. 10 is a perspective view of the second portion of the frame of the auxiliary assembly in a vertically raised position.

As shown in FIGS. 9 and 10, the second auxiliary frame portion 226 may include a pair of side members 234 and a front member 236 extending between and attached to the side members 234. Each of the side members 234 may include a track 238 defining channels that slidably receive flanges 240 (FIG. 8) of the fore-aft support members 230 of the first auxiliary frame portion 224. A cross member 235 may be attached to and extend between the side members 234 and may include a pair of casters or wheels 242 that may roll along the floor or ground surface as the second auxiliary frame portion 226 moves in a fore-aft direction relative to the first auxiliary frame portion 224.

As shown in FIGS. 9 and 10, the second auxiliary frame portion 226 may also include a platform (e.g., a seat platform) 244 and a scissor linkage 246. The scissor linkage 246 is mounted to the platform 244 and the side members 234 and may include a pair of first links 248 and a pair of second links 250. Each of the first links 248 may be rotatably mounted at a first end 247 to the front member 236 and may be slidably and rotatably mounted at a second end 249 to tracks 260 attached to the platform 244. Each of the second links 250 may be rotatably mounted at a first end 251 to the platform 244 and may be slidably and rotatably mounted at a second end 253 to tracks 262 attached to the side members 234. An intermediate portion of one of the first links 248 is pivotably coupled to an intermediate portion of one of the second links 250, and an intermediate portion of the other of the first links 248 is pivotably coupled to an intermediate portion of the other of the second links 250.

A first cross member 264 (FIGS. 9 and 10) extends between and is attached to the second ends 249 of the first links 248. A second cross member 266 (FIG. 9) extends between and is attached to the first ends 251 of the second links 250. An actuator 268 extends between and is attached to the first and second cross members 264, 266. The actuator 268 may include a motor 270 and a pair of telescoping shafts 272 that are driven by the motor 270. Telescoping movement of the telescoping shafts 272 caused by operation of the motor 270 moves the first and second cross members 264, 266 toward and away from each other to move the scissor linkage 246 and the platform 244 in a vertical direction relative to the side and front members 234, 236.

As shown in FIGS. 11 and 14, the third seat bottom 222 and third seatback 223 are mounted to the platform 244. Therefore, operation of the actuator 268 causes the third seat bottom 222 and the third seatback 223 to move vertically relative to the first auxiliary frame portion 224 and relative to the first and second seat assemblies 12, 14.

As shown in FIGS. 13 and 14, another actuator 274 may be mounted to one of the lateral support members 228 (e.g., via bracket 275 shown in FIGS. 5 and 8) of the first auxiliary frame portion 224 and to the front member 236 of the second auxiliary frame portion 226 (e.g., via bracket 277 shown in FIGS. 9 and 10). The actuator 274 may include a motor 276 and a pair of telescoping shafts 278 that are driven by the motor 276. Telescoping movement of the telescoping shafts 278 caused by operation of the motor 276 moves the second auxiliary frame portion 226 relative to the first auxiliary frame portion 224 in the fore-aft direction, as shown in FIGS. 13 and 16. That is, operation of the actuator 274 causes the second auxiliary frame portion 226 to move in the fore-aft direction relative to the first auxiliary frame portion 224 via the slidable engagement between the tracks 238 (FIGS. 9 and 10) of the second auxiliary frame portion 226 and the flanges 240 (FIG. 8) of the first auxiliary frame portion 224.

As shown in FIGS. 13 and 14, yet another actuator 280 may be mounted to the interior support frames 27, 127 (via brackets 33, 133 shown in FIGS. 6 and 7) of the first and second frames 20, 120. The actuator 280 may include a motor 282 and a pair of telescoping shafts 284 that are driven by the motor 282. Telescoping movement of the telescoping shafts 284 caused by operation of the motor 282 moves the interior support frames 27, 127 (and thus, the first and second seat assemblies 12, 14) toward and away from each other in the lateral direction between the retracted and extended positions, as shown in FIGS. 13 and 16. As the interior support frames 27, 127 move toward and away from each other, the wheels 232 on the lateral support members 228 of the first auxiliary frame portion 224 roll along the tracks 34, 134 of the interior support frames 27, 127. Therefore, operation of the actuator 280 causes relative movement among the first frame 20, the second frame 120 and the auxiliary frame 220 in the lateral direction (and thus, relative movement among the first seat assembly 12, the second seat assembly 14 and the auxiliary assembly 16 in the lateral direction).

With continued reference to FIGS. 1-16, operation of the furniture member 10 will be described in detail. As described above, the furniture member 10 is movable between a first position (FIG. 1) in which the furniture member 10 has a first seating capacity and a second position (FIG. 4) in which the furniture member 10 has a second seating capacity that is greater than the first seating capacity. To move the furniture member 10 from the first position to the second position, the user may actuate the actuator 280 to move the first and second seat assemblies 12, 14 in the lateral direction from the retracted position (FIG. 1) to the extended position (FIG. 2). Once the first and second seat assemblies 12, 14 are in the extended position, the user can actuate the actuators 268, 274 (either simultaneously or sequentially) to move the auxiliary assembly 16 from the stowed position (FIG. 2) to the deployed position (FIG. 4).

When the auxiliary assembly 16 is in the stowed position, a seating surface 241 of the third seat bottom 222 (e.g., a vertically upward-facing surface upon which a user may sit or lay) is disposed vertically below seating surfaces 41, 141 of the first and second seat bottoms 22, 122 (i.e., vertically between the seat bottoms 22, 122 and the ground surface upon which the furniture member 10 is disposed) and a backrest surface 243 of the third seatback 223 is disposed horizontally behind backrest surfaces 43, 143 of the first and second seatbacks 23, 123 (i.e., horizontally between the rearward-most portions of the outer panels 28, 128 and the backrest surfaces 43, 143 of the seatbacks 23, 123). From the stowed position, the actuator 274 can be actuated to move the auxiliary assembly 16 forward in the fore-aft direction (perpendicular to the lateral direction and the vertical direction) until the backrest surface 243 of the third seatback 223 is substantially level with or horizontally in line with the backrest surfaces 43, 143 of the first and second seatbacks 23, 123. From the stowed position (or from the position shown in FIG. 3 in which the auxiliary assembly 16 has been moved forward in the fore-aft direction), the actuator 268 can be actuated to move the auxiliary assembly 16 vertically upward in the vertical direction (perpendicular to the lateral direction and the fore-aft direction) until the seating surface 241 of the third seat bottom 222 is substantially level with or vertically in line with the seating surfaces 41, 141 of the first and second seat bottoms 22, 122.

In some configurations, the auxiliary assembly 16 can be moved forward in the fore-aft direction and upward in the vertical direction simultaneously or sequentially (i.e., forward in the fore-aft direction and then upward in the vertical direction, or upward in the vertical direction and then forward in the fore-aft direction). In some configurations, the auxiliary assembly 16 may need to be moved forward in the fore-aft direction before moving upward in the vertical direction when moving the auxiliary assembly 16 from the stowed position to the deployed position.

While the auxiliary assembly 16 is described above and shown in the figures as a seat assembly, in some configurations, the auxiliary assembly could be an auxiliary console assembly (e.g., a center console assembly) that could include one or more of a table, cup holders, armrests and/or a storage compartment, for example, or any other feature. Furthermore, any one or more of the first seat assembly, the second seat assembly or the auxiliary assembly could include an extendable and retractable legrest assembly. Furthermore, while the furniture member 10 shown in the figures is a sofa including first and second seat assemblies 12, 14 and the auxiliary assembly 16, in some configurations, the furniture member 10 could be a chair, loveseat, or chaise, for example, and could include any number of seat assemblies (e.g., a single seat assembly or a plurality of seat assemblies) and one or more auxiliary assemblies (e.g., one or more auxiliary seat assemblies and/or one or more auxiliary console assemblies).

Referring now to FIGS. 17-19, another furniture member 510 is provided that may include a first seat assembly 512, a second seat assembly 514, and a center console assembly (e.g., an auxiliary assembly) 516. The second seat assembly 514 is movable relative to the first seat assembly 512 between a retracted position (FIG. 17) and an extended position (FIGS. 18 and 19). The center console assembly 516 is movable relative to the first and second seat assemblies 512, 514 between a stowed position (FIG. 17) and a deployed position (FIGS. 18 and 19).

The structure and function of the first and second seat assemblies 512, 514 may be similar or identical to that of the first and second seat assemblies 12, 14 described above, and therefore, will not be described again in detail.

The structure and function of the center console assembly 516 may be generally similar to that of the auxiliary assembly 16 described above, and therefore, similar features will not be described again in detail. Briefly, the center console assembly 516 may include an auxiliary frame (not shown; similar or identical to the auxiliary frame 220) and a console 522 mounted to the auxiliary frame. Like the auxiliary frame 220, the auxiliary frame of the furniture member 510 is movably mounted to the first and second and second seat assemblies 512, 514 to allow for relative movement among the center console assembly 516, the first seat assembly 512 and the second seat assembly 514. Like the auxiliary frame 220, the auxiliary frame of the furniture member 510 may include a first auxiliary frame portion (similar or identical to the first auxiliary frame portion 224) and a second auxiliary frame portion (similar or identical to the second auxiliary frame portion 226) that is movable relative to the first auxiliary frame portion.

As shown in FIGS. 18 and 19, the console 522 may include a base 521 having one or more cup holders 523 and one or more armrests 524. The one or more armrests 524 may be pivotable relative to the base 521 between a down position (FIG. 18) and an up position (FIG. 19). In the down position, one or more users seated in the first and/or second seat assemblies 512, 514 may rest his or her arm on the armrest 524. While not shown in the figures, the center console assembly 516 could include a storage compartment, a table, and/or other features.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a first seat assembly including a first seat bottom and a first seatback;

a second seat assembly including a second seat bottom and a second seatback, the second seat assembly connected to the first seat assembly and movable relative to the first seat assembly between a retracted position in which the first seat bottom and the first seatback are adjacent to the second seat bottom and the second seatback, respectively, and an extended position in which the first seat bottom and the first seatback are spaced apart from the second seat bottom and the second seatback, respectively; and an auxiliary assembly connected to the first and second seat assemblies, the auxiliary assembly is movable between a stowed position in which the auxiliary assembly is disposed vertically between a ground surface upon which the furniture member is disposed and the first and second seat assemblies and a deployed position in which at least a portion of the auxiliary assembly is disposed vertically higher than in the stowed position, wherein the second seat assembly is movable in a lateral direction relative to the first seat assembly between the retracted and extended positions, wherein the auxiliary assembly is movable relative to the first and second seat assemblies in the lateral direction, and wherein movement of the second seat assembly between the retracted and extended positions causes movement of the auxiliary assembly in the lateral direction.

2. The furniture member of claim 1, wherein the auxiliary assembly is disposed laterally between the first and second seat bottoms when the auxiliary assembly is in the deployed position.

3. The furniture member of claim 1, wherein the auxiliary assembly is movable to the deployed position only when the second seat assembly is in the extended position.

4. The furniture member of claim 3, wherein the second seat assembly is movable to the retracted position only when the auxiliary assembly is the stowed position.

5. The furniture member of claim 4, wherein the auxiliary assembly includes a third seat bottom, a third seatback, and an auxiliary frame supporting the third seat bottom and the third seatback.

6. The furniture member of claim 5, further comprising a first actuator attached to the first and second seat assemblies and selectively moving the second seat assembly relative to the first seat assembly between the retracted and extended positions.

7. The furniture member of claim 1, wherein the auxiliary assembly includes an auxiliary frame including a first auxiliary frame portion and a second auxiliary frame portion that is movable relative to the first auxiliary frame portion.

8. The furniture member of claim 7, wherein the first auxiliary frame portion is mounted to the first and second seat assemblies and movable relative to the first and second seat assemblies in the lateral direction as the second seat assembly moves between the retracted and extended positions.

9. The furniture member of claim 8, wherein the second auxiliary frame portion is mounted to the first auxiliary frame portion for movement relative to the first auxiliary frame portion in a vertical direction and in a fore-aft direction, wherein the vertical direction is perpendicular to the lateral direction, and wherein the fore-aft direction is perpendicular to the lateral direction and the vertical direction.

10. The furniture member of claim 9, wherein the auxiliary assembly includes a second actuator mounted to the first and second auxiliary frame portions and selectively moving the second auxiliary frame portion in the fore-aft direction relative to the first auxiliary frame portion and the first and second seat assemblies.

11. The furniture member of claim 10, wherein the auxiliary assembly includes a third actuator mounted to a seat platform of the second auxiliary frame portion and selectively moving the seat platform in the vertical direction relative to the first auxiliary frame portion and the first and second seat assemblies.

12. The furniture member of claim 11, wherein the second auxiliary frame portion includes a scissor linkage mounted to the seat platform and driven by the third actuator.

13. The furniture member of claim 1, further comprising a plurality of first legs and a plurality of second legs supporting the furniture member relative to the ground surface, the first legs are attached to a frame of the first seat assembly, the second legs are attached to a frame of the second seat assembly, wherein the second legs include wheels.

14. The furniture member of claim 13, wherein each of the second legs includes a recess in which a portion of a corresponding one of the wheels is disposed.

15. The furniture member of claim 14, further comprising a plurality of intermediate rollers disposed between the plurality of first legs and the plurality of second legs, wherein the intermediate rollers are mounted to a frame of the second seat assembly.

16. The furniture member of claim 1, wherein the first seat assembly includes a first frame, the second seat assembly includes a second frame, and the auxiliary assembly includes an auxiliary frame, and wherein the first and second frames include tracks in which the auxiliary frame is linearly movable to facilitate movement of the second seat assembly between the retracted and extended positions.

17. The furniture member of claim 1, wherein the auxiliary assembly includes a center console assembly disposed laterally between the first and second seat assemblies in the deployed position.

18. The furniture member of claim 17, wherein the center console assembly includes a cup holder and an armrest.

19. The furniture member of claim 17, wherein the center console assembly includes a cup holder or an armrest.

20. A furniture member comprising:

a first seat assembly including a first seat bottom and a first seatback; and an auxiliary assembly connected to the first seat assembly and including an auxiliary seat bottom and an auxiliary seatback, the auxiliary assembly is movable between a stowed position and a deployed position, wherein when the auxiliary assembly is in the stowed position, the auxiliary seat bottom is disposed vertically between the first seat bottom and a ground surface upon which the furniture member is disposed, and the auxiliary seatback is disposed horizontally between the first seatback and a rear end of the furniture member, wherein when the auxiliary assembly is in the deployed position, a seating surface of the auxiliary seat bottom is vertically level with a seating surface of the first seat bottom, and the auxiliary seatback is horizontally level with the first seatback.

21. The furniture member of claim 20, further comprising a second seat assembly including a second seat bottom and a second seatback, the second seat assembly connected to the first seat assembly and movable relative to the first seat assembly between a retracted position in which the first seat bottom and the first seatback are adjacent to the second seat bottom and the second seatback, respectively, and an extended position in which the first seat bottom and the first seatback are spaced apart from the second seat bottom and the second seatback, respectively.

22. The furniture member of claim 21, wherein the auxiliary assembly is disposed laterally between the first and second seat bottoms when the auxiliary assembly is in the deployed position.

23. The furniture member of claim 21, wherein the auxiliary assembly is movable to the deployed position only when the second seat assembly is in the extended position.

24. The furniture member of claim 23, wherein the second seat assembly is movable to the retracted position only when the auxiliary assembly is the stowed position.

25. The furniture member of claim 21, further comprising a first actuator attached to the first and second seat assemblies and selectively moving the second seat assembly relative to the first seat assembly between the retracted and extended positions.

26. The furniture member of claim 21, further comprising a plurality of first legs and a plurality of second legs supporting the furniture member relative to the ground surface, the first legs are attached to a frame of the first seat assembly, the second legs are attached to a frame of the second seat assembly, wherein the second legs include wheels.

27. The furniture member of claim 26, wherein each of the second legs includes a recess in which a portion of a corresponding one of the wheels is disposed.

28. The furniture member of claim 27, further comprising a plurality of intermediate rollers disposed between the plurality of first legs and the plurality of second legs, wherein the intermediate rollers are mounted to a frame of the second seat assembly.

29. The furniture member of claim 21, wherein the first seat assembly includes a first frame, the second seat assembly includes a second frame, and the auxiliary assembly includes an auxiliary frame, and wherein the first and second frames include tracks in which the auxiliary frame is linearly movable to facilitate movement of the second seat assembly between the retracted and extended positions.

30. The furniture member of claim 20, wherein the auxiliary assembly includes an auxiliary frame including a first auxiliary frame portion and a second auxiliary frame portion that is movable relative to the first auxiliary frame portion.

31. The furniture member of claim 30, wherein the first auxiliary frame portion is mounted to the first seat assembly and movable relative to the first seat assembly in a lateral direction.

32. The furniture member of claim 31, wherein the second auxiliary frame portion is mounted to the first auxiliary frame portion for movement relative to the first auxiliary frame portion in a vertical direction and in a fore-aft direction, wherein the vertical direction is perpendicular to the lateral direction, and wherein the fore-aft direction is perpendicular to the lateral direction and the vertical direction.

33. The furniture member of claim 32, wherein the auxiliary assembly includes a second actuator mounted to the first and second auxiliary frame portions and selectively moving the second auxiliary frame portion in the fore-aft direction relative to the first auxiliary frame portion and the first seat assembly.

34. The furniture member of claim 33, wherein the auxiliary assembly includes a third actuator mounted to a seat platform of the second auxiliary frame portion and selectively moving the seat platform in the vertical direction relative to the first auxiliary frame portion and the first seat assembly.

35. The furniture member of claim 34, wherein the second auxiliary frame portion includes a scissor linkage mounted to the seat platform and driven by the third actuator.

36. A furniture member comprising:

a first seat assembly including a first seat bottom and a first seatback;

a second seat assembly including a second seat bottom and a second seatback, the second seat assembly connected to the first seat assembly and movable in a lateral direction relative to the first seat assembly between a retracted position in which the first seat bottom and the first seatback are adjacent to the second seat bottom and the second seatback, respectively, and an extended position in which the first seat bottom and the first seatback are spaced apart from the second seat bottom and the second seatback, respectively; and an auxiliary assembly connected to the first and second seat assemblies, the auxiliary assembly is movable between a stowed position in which the auxiliary assembly is disposed vertically between a ground surface upon which the furniture member is disposed and the first and second seat assemblies and a deployed position in which the auxiliary assembly is disposed laterally between the first and second seat assemblies and vertically higher than in the stowed position, wherein the auxiliary assembly includes an auxiliary frame including a first auxiliary frame portion and a second auxiliary frame portion that is movable relative to the first auxiliary frame portion in a vertical direction and in a fore-aft direction, wherein the vertical direction is perpendicular to the lateral direction, and wherein the fore-aft direction is perpendicular to the lateral direction and the vertical direction, and wherein the auxiliary assembly includes an actuator mounted to the first and second auxiliary frame portions and selectively moving the second auxiliary frame portion in the fore-aft direction relative to the first auxiliary frame portion and the first and second seat assemblies.

37. The furniture member of claim 36, wherein the auxiliary assembly includes a center console assembly.

38. The furniture member of claim 37, wherein the center console assembly includes a cup holder or an armrest.

39. The furniture member of claim 37, wherein the center console assembly includes a cup holder and an armrest.

40. The furniture member of claim 36, wherein the auxiliary assembly is movable to the deployed position only when the second seat assembly is in the extended position.

41. The furniture member of claim 40, wherein the second seat assembly is movable to the retracted position only when the auxiliary assembly is the stowed position.

42. The furniture member of claim 41, further comprising another actuator attached to the first and second seat assemblies and selectively moving the second seat assembly relative to the first seat assembly between the retracted and extended positions.

43. The furniture member of claim 36, wherein the first auxiliary frame portion is mounted to the first and second seat assemblies and movable relative to the first and second seat assemblies in the lateral direction as the second seat assembly moves between the retracted and extended positions.

44. The furniture member of claim 36, wherein the auxiliary assembly includes another actuator mounted to the second auxiliary frame portion and selectively moving the second auxiliary frame portion in the vertical direction relative to the first auxiliary frame portion and the first and second seat assemblies.

45. The furniture member of claim 44, wherein the second auxiliary frame portion includes a scissor linkage that moves the second auxiliary frame portion in the vertical direction relative to the first auxiliary frame portion.

46. The furniture member of claim 36, further comprising a plurality of first legs and a plurality of second legs supporting the furniture member relative to the ground surface, the first legs are attached to a frame of the first seat assembly, the second legs are attached to a frame of the second seat assembly, wherein the second legs include wheels.

47. The furniture member of claim 46, wherein each of the second legs includes a recess in which a portion of a corresponding one of the wheels is disposed.

48. The furniture member of claim 47, further comprising a plurality of intermediate rollers disposed between the plurality of first legs and the plurality of second legs, wherein the intermediate rollers are mounted to a frame of the second seat assembly.

49. The furniture member of claim 36, wherein the first seat assembly includes a first frame, wherein the second seat assembly includes a second frame, and wherein the first and second frames include tracks in which the auxiliary frame is linearly movable to facilitate movement of the second seat assembly between the retracted and extended positions.

50. The furniture member of claim 36, wherein the auxiliary assembly includes an auxiliary seat bottom and an auxiliary seatback.

* * * * *